US012692040B2

(12) United States Patent
Ma et al.

(10) Patent No.: US 12,692,040 B2
(45) Date of Patent: Jul. 28, 2026

(54) PRODUCT CONTAINER

(71) Applicant: THE CLOROX COMPANY, Oakland, CA (US)

(72) Inventors: Ben Ma, Pleasanton, CA (US); Li Zhang, Pleasanton, CA (US); Katie Kicklighter, Pleasanton, CA (US)

(73) Assignee: THE CLOROX COMPANY, Oakland, CA (US)

( * ) Notice: Subject to any disclaimer, the term of this patent is extended or adjusted under 35 U.S.C. 154(b) by 112 days.

(21) Appl. No.: 18/655,531

(22) Filed: May 6, 2024

(65) Prior Publication Data

US 2024/0375817 A1 Nov. 14, 2024

Related U.S. Application Data

(60) Provisional application No. 63/591,543, filed on Oct. 19, 2023, provisional application No. 63/500,768,
(Continued)

(51) Int. Cl.
*B65D 5/72* (2006.01)
*B65D 5/468* (2006.01)
(Continued)

(52) U.S. Cl.
CPC ..... *B65D 5/725* (2013.01); *B65D 5/4608* (2013.01); *B65D 5/48* (2013.01); *B65D 77/06* (2013.01); *B65D 77/062* (2013.01); *B65D 77/065* (2013.01)

(58) Field of Classification Search
CPC ..... B65D 5/725; B65D 5/4608; B65D 5/48; B65D 77/06; B65D 77/062; B65D 77/065
(Continued)

(56) References Cited

U.S. PATENT DOCUMENTS 5,085,346 A 2/1992 Wright
7,150,377 B2 12/2006 Cook et al.
(Continued)

FOREIGN PATENT DOCUMENTS

FR 1441962 A 6/1966
FR 2982592 A1 5/2013
(Continued)

OTHER PUBLICATIONS

Invitation to Pay Additional Fees and, Where Applicable, Protest Fee and Communication Relating to the Results of the Partial International Search in corresponding PCT Application No. PCT/US2024/028120, mailed Oct. 11, 2024, 14 pages.
(Continued)

*Primary Examiner* — David J Walczak
(74) *Attorney, Agent, or Firm* — Edell, Shapiro & Finnan, LLC

(57) ABSTRACT

A container includes a housing that defines an interior region. Inside the interior region is a storage unit and a dispensing device. The dispensing device can receive a composition and spray or distribute the composition as desired. The dispensing device is refillable with more of the composition. The storage unit defines a chamber or interior volume in which more of the composition can be located. When the dispensing device needs to be refilled, the dispensing device can be positioned proximate to a release mechanism coupled to the storage unit, which controls how much of the composition exits the storage unit. The release mechanism can be a spigot-like structure that is manipulated by a user to release composition from the storage unit and refill the dispensing device.

20 Claims, 26 Drawing Sheets

Related U.S. Application Data filed on May 8, 2023, provisional application No. 63/500,777, filed on May 8, 2023.

(51) Int. Cl.
*B65D 5/48* (2006.01)
*B65D 77/06* (2006.01)

(58) Field of Classification Search
USPC ..... 222/105
See application file for complete search history.

(56) References Cited

U.S. PATENT DOCUMENTS

| | | | | |
|---|---|---|---|---|
| 7,681,783 | B2 | 3/2010 | Stephenson | |
| 8,225,958 | B2 | 7/2012 | Nielsen et al. | |
| 8,556,124 | B2 | 10/2013 | Edwards | |
| 8,672,184 | B2 | 3/2014 | Edwards | |
| 9,193,512 | B2 | 11/2015 | Brooks | |
| 9,415,990 | B2 | 8/2016 | Campanelli et al. | |
| 9,533,814 | B2 | 1/2017 | Brooks | |
| 9,758,285 | B2 | 9/2017 | Brooks | |
| 9,862,532 | B2 * | 1/2018 | McRae | B65D 85/72 |
| D903,487 | S | 12/2020 | Bohache et al. | |
| 10,882,677 | B2 | 1/2021 | Malott et al. | |
| 10,919,681 | B2 | 2/2021 | Bohache et al. | |
| 10,981,711 | B2 | 4/2021 | Smith | |
| 11,040,815 | B2 | 6/2021 | Ficke et al. | |
| 11,261,976 | B2 | 3/2022 | Johnson | |
| 2011/0036864 | A1 * | 2/2011 | McKenna | F25D 31/006 222/105 |
| 2015/0108165 | A1 * | 4/2015 | Merner | B65D 77/067 222/105 |
| 2021/0339160 | A1 | 11/2021 | Wasserman et al. | |

FOREIGN PATENT DOCUMENTS

| | | | |
|---|---|---|---|
| WO | 2011/017400 | A1 | 2/2011 |
| WO | 2015/164874 | A1 | 10/2015 |
| WO | 2021/087280 | A1 | 5/2021 |

OTHER PUBLICATIONS

Notification of Transmittal of International Search Report and Written Opinion including International Search Report and Written Opinion for International Application No. PCT/US2024/028120 dated Dec. 2, 2024, 19 pages.

target.com, "Tide Liquid Laundry Detergent Eco-Box," retrieved from https://web.archive.org/web/20220128125416/https://www.target.com/p/tide-liquid-laundry-detergent-eco-box-original-scent-105-fl-oz/-/A-75663826 on Apr. 29, 2024, 4 pages.

* cited by examiner

PRODUCT CONTAINER

CROSS-REFERENCE TO RELATED PATENT APPLICATIONS

This U.S. non-provisional patent application claims priority to and the benefit of each of these three U.S. provisional patent applications: U.S. Patent App. No. 63/500,768, entitled "Product Container,", filed May 8, 2023; U.S. Patent App. No. 63/500,777, entitled "Product Container,", filed May 8, 2023; and U.S. Patent App. No. 63/591,543, entitled "Product Container,", filed Oct. 19, 2023. The entire disclosure of each of the above-identified three U.S. provisional patent applications is incorporated by reference herein in its entirety.

FIELD OF THE INVENTION

The present invention is directed generally to a product container, and more specifically, to a product container that includes a storage unit containing a composition and a refillable dispensing device.

BACKGROUND

Containers that have a product therein are well known. In some instances, a liquid product can be provided in a housing. Often, the containers can be cumbersome and difficult to use, particularly, when attempting to dispense or release the liquid. Many times a funnel is required when pouring out a liquid.

Conventional containers that include a wall and an inner chamber in which a liquid product is located often have several limitations. One limitation is that a hole must be punctured through the wall of the container, which is used by a consumer to open a perforation in the container to access the inner chamber. However, puncturing a hole in the container is difficult when there is a full bag of liquid behind the wall. Another limitation is that the size of the door for conventional containers is limited, because if the door opening is too large, the bag inside of the container bulges out. Another limitation is that when a door of a conventional container is closed to lock a spout, the bag in the container pushes on the door, which results in the door not being secured and the spout not retained in place. A yet another limitation of a conventional container is that it has a single layer of corrugated board in the area in the housing wall where the spout is repeatedly extended and retracted, which wears out the housing wall. Finally, another limitation is that conventional containers do not provide a mechanism for a user to see how much product remains in the container. As a result, a user may be surprised when the product in the container is gone, and may not have additional product available.

There is a need to reduce the amount of material used, and the amount of space needed, to transport or ship a certain quantity of a composition. There is also a need for a container that makes the shipping, storing, dispensing, and utilizing of a composition easier and simpler. There is another need in some instances to provide a two-level seal for shipping, depending on the composition being shipped.

In addition, there is a need for an easy opening container that reduces the risk of puncturing the bag in the container. There is also a need for a larger door size in a container to provide easier access to the spout and to facilitate removal and storage thereof. Also, there is a need for a secure way to lock the access door and the spout when the spout extends from the housing. There is a need for a multiple layer wall portion where the spout is extended and stored to improve the stability and durability of the container. There is also a need for an easy way for a user to check on the remaining volume of the material in the container.

SUMMARY

The present invention relates to a container that includes a housing that defines an interior region. Inside the interior region is a storage unit and a dispensing device. The dispensing device can receive a composition and thereafter, spray or distribute the composition as desired. The dispensing device is subsequently refillable with more of the composition from the storage unit. The storage unit defines a chamber or interior volume in which the composition can be located. When the dispensing device needs to be refilled, the dispensing device can be positioned proximate to a release mechanism coupled to the storage unit, which controls the exiting of the composition from the storage unit. The release mechanism can be a spigot-like structure that is manipulated by a user to release composition from the storage unit and refill the dispensing device. In alternative embodiments, the release mechanism can be a push button, a pull lever, a pivoting handle, or a similar structure.

By providing a refillable dispensing device with a more voluminous storage unit, a user can repeated fill the same dispensing device many times with the composition in the same storage unit. As a result, fewer dispensing devices are needed because of the reusability of the dispensing device. That reusability reduces the overall use of material (fewer dispensing devices), reduces the space needed to ship a certain amount of composition (previously the composition was shipped in dispensing device), reduces the quantity of shipping pallets used, and reduces the quantity of transportation vehicles needed.

In one embodiment, at least 50% more products using the container of the present invention can be shipped as compared to conventional products. This is due to the refillable container being a small portion of the shipped product and the volume of the composition that can be included in the storage unit. Moreover, at least 66% more containers according to the present invention can be fit on a shelf at retail because the containers do not have an outwardly extending release mechanism that would limit or restrict the placement of the container adjacent and in contact with each other.

In an embodiment of the invention, the release mechanism or spigot is located inside of the container, thereby protecting the release mechanism. When a user wants to utilize the release mechanism, the user can manipulate a portion of the container housing to access and move the release mechanism.

In some instances, two levels of sealing protection is needed to ship certain compositions. In the present invention, the composition is located in either a storage unit in the container housing or a dispensing device located in the container housing. The storage unit and the dispensing device each provide a first level of sealing protection. Each of the storage unit and the dispensing device is located in the housing of the container, which provides a second level of sealing protection. By using the container housing as a sealing level instead of an additional piece of polypropylene or polyethylene material wrapped onto the dispensing device, less material, particularly plastic material, is used. In addition, more recyclable material is used, thereby increasing the overall recyclability of the product.

In one embodiment, a container comprises a housing defining an interior region, a storage unit disposed in the interior region, a composition disposed in the storage unit, a release mechanism coupled to the storage unit, the release mechanism being manipulatable to allow the composition to exit the storage unit, and a dispensing device disposed in the interior region, the dispensing device including a chamber and one of a spraying mechanism or a closure.

In an alternative embodiment, the interior region includes a first interior region portion and a second interior region portion, and the housing includes a barrier disposed in the interior region, the barrier being located between the first interior region portion and the second interior region portion. In another embodiment, the storage unit is located in the first interior region portion, and the dispensing device is disposed in the second interior region portion. In yet another embodiment, the housing includes a main body portion and a removable portion coupled to the main body portion via perforations, and the removable portion can be separated from the main body portion due to the perforations.

In one embodiment, the housing includes an access door coupled thereto and movable between a closed position and an opened position, and the access door includes a recess formed therein that receives a portion of the release mechanism when the release mechanism is in an extended position relative to the housing. In another embodiment, the housing includes a plurality of walls, and one of the plurality of walls includes a handle opening formed therein and a removable portion coupled thereto that can be separated from the housing. Additionally, removal of the removable portion forms a wall opening through the housing, the wall opening extends from an exterior of the housing to an interior of the housing. Alternatively, the wall opening is in communication with the handle opening. Also, the housing includes a panel located in the interior region, the panel is positioned adjacent to the wall opening, and the panel blocks at least a portion of the wall opening.

In another embodiment, the housing includes a wall and a panel located in the interior region adjacent to the wall, the wall includes a first opening formed therein through which the release mechanism can extend, and the panel includes a second opening formed therein through which the release mechanism can extend. In an alternative embodiment, the first opening has a different size than the second opening. In another embodiment, the panel blocks a portion of the first opening, and the panel in combination with the wall retains the storage unit in the housing. Also, the housing includes a handle opening, the panel includes a third opening, the third opening of the panel being aligned with the handle opening, and the second opening of the panel is aligned with the first opening of the wall.

In a different embodiment of the invention, a container comprises a housing including a plurality of walls defining an interior region, a storage unit disposed in the interior region, the storage unit including a composition disposed therein, and a release mechanism coupled thereto, the release mechanism being manipulatable to allow the composition to exit the storage unit, the release mechanism being positionable in a retracted position and in an extended position, and a panel disposed in the interior region, the panel being located adjacent to one of the plurality of walls of the housing, and the panel having an opening through which the release mechanism extends when in its extended position.

In one embodiment, the container includes an internal divider that separates the interior region into a first interior region portion and a second interior region portion, the storage unit is located in the first interior region portion, and the panel is coupled to the internal divider. In another embodiment, the one of the plurality of walls of the housing includes a removable portion coupled thereto, removal of the removable portion from the one of the plurality of walls forms a wall opening, and the panel is located adjacent to the wall opening and blocks a portion of the wall opening. In yet another embodiment, the housing includes a door coupled thereto, the door being movable between a closed position and an opened position relative to the housing, and the door engages a portion of the release mechanism when the release mechanism is in an extended position to secure the release mechanism in its extended position.

In a different embodiment of the invention, a container comprises a housing including a plurality of walls defining an interior region, one of the plurality of walls including a removable portion coupled thereto, a first opening being formed in the one of the plurality of walls when the removable portion is separated therefrom, a storage unit disposed in the interior region, the storage unit including a chamber in which a composition is disposed, and a release mechanism coupled thereto, the release mechanism being actuatable to release the composition from the chamber of the storage unit, the release mechanism being disposable in a retracted position and in an extended position relative to the housing, and a panel disposed in the interior region of the housing, the panel having a second opening formed therein, wherein the release mechanism extends through the first opening and the second opening when the release mechanism is in its extended position.

In another embodiment, the panel is located adjacent to the first opening and blocks a portion of the first opening. In an alternative embodiment, the one of the plurality of walls includes a third opening formed therein, and the first opening is in communication with the third opening.

DETAILED DESCRIPTION

Figure 1:
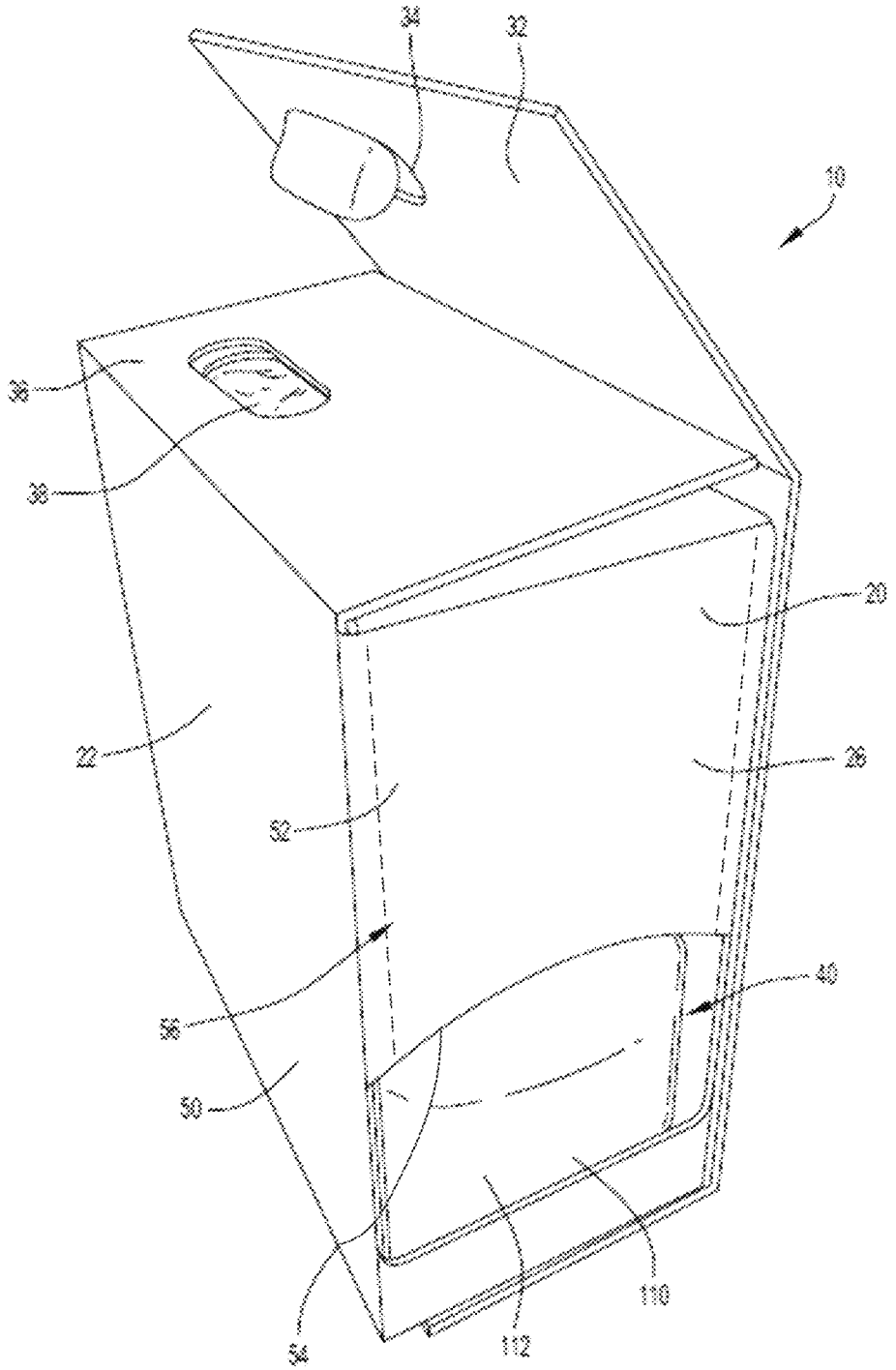
FIG. 1 is a perspective view of an embodiment of a container according to the present invention.

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In one embodiment, a container includes one or more sets of perforations that facilitate assembling the bag-in-box structure. A consumer or user can open the container upon first use easily using the perforations. The user can then lock a release mechanism or spout securely in an extended position relative to the container. After the release mechanism has been used, the release mechanism can be placed back into the container. With the release mechanism in an interior region of the container, the container can be stored conveniently on a shelf or in a cabinet or other support structure.

In one embodiment, a panel is added to an internal divider or barrier that is located in the container. The panel is positioned inside the container and located behind a panel or wall of the container. That particular panel or wall is the location at which a user opens the container for a first use thereof. The container with the set or sets of perforations and the panel provides several benefits.

One benefit is to have the perforation to open the container start from the opening of the handle, which results in the formation of a handle opening. Once the handle is opened, a user can easily insert one or more fingers behind the panel, which in some instances may be a front panel, and pull on a removable panel or door to separate it from the container housing. This design eliminates the need to puncture a hole in the panel adjacent to the storage unit.

Another benefit is that the container includes an additional panel behind the door opening or removable portion opening to block the bag or storage unit from bulging out of the container. As a result, the opening can be made larger than in conventional containers, thereby providing easier access for a user to pull out the spout.

An additional benefit is an improved locking of the spout in its extended position. The container includes a panel behind an access door to block the bag, and prevent the bag from pressing on the access door. As a result, the access door stays in its position and better secures the spout when a consumer uses it for refilling.

Another benefit of the panel in the container is that the panel provides a second layer of corrugated boards in certain areas, thereby making the container more durable for multiple uses. Consumer can move the spout back into the container, close the access door, and store the container in a cabinet or on a shelf without the spout sticking out, which saves storage space and reduces the likelihood of product dripping out of the box.

Another benefit is that the container can include an opening through which a user can view the contents of the container. In different embodiments, that opening can be placed on the panel that is inside of the container or on a different portion of an internal divider located in the container. The opening can be located and sized so that a consumer can see the material (such as a liquid) in the bag or storage unit in the container, and determine or estimate how much remains.

Another benefit is that the panel or insert provided in the container can be manufactured by a standard machine that is used to pack out the bag-in-box. No special manufacturing equipment is needed to manufacture and assemble the panel with the container. As a result, the manufacturing of the panel does not make the product process more complicated.

Figure 2:
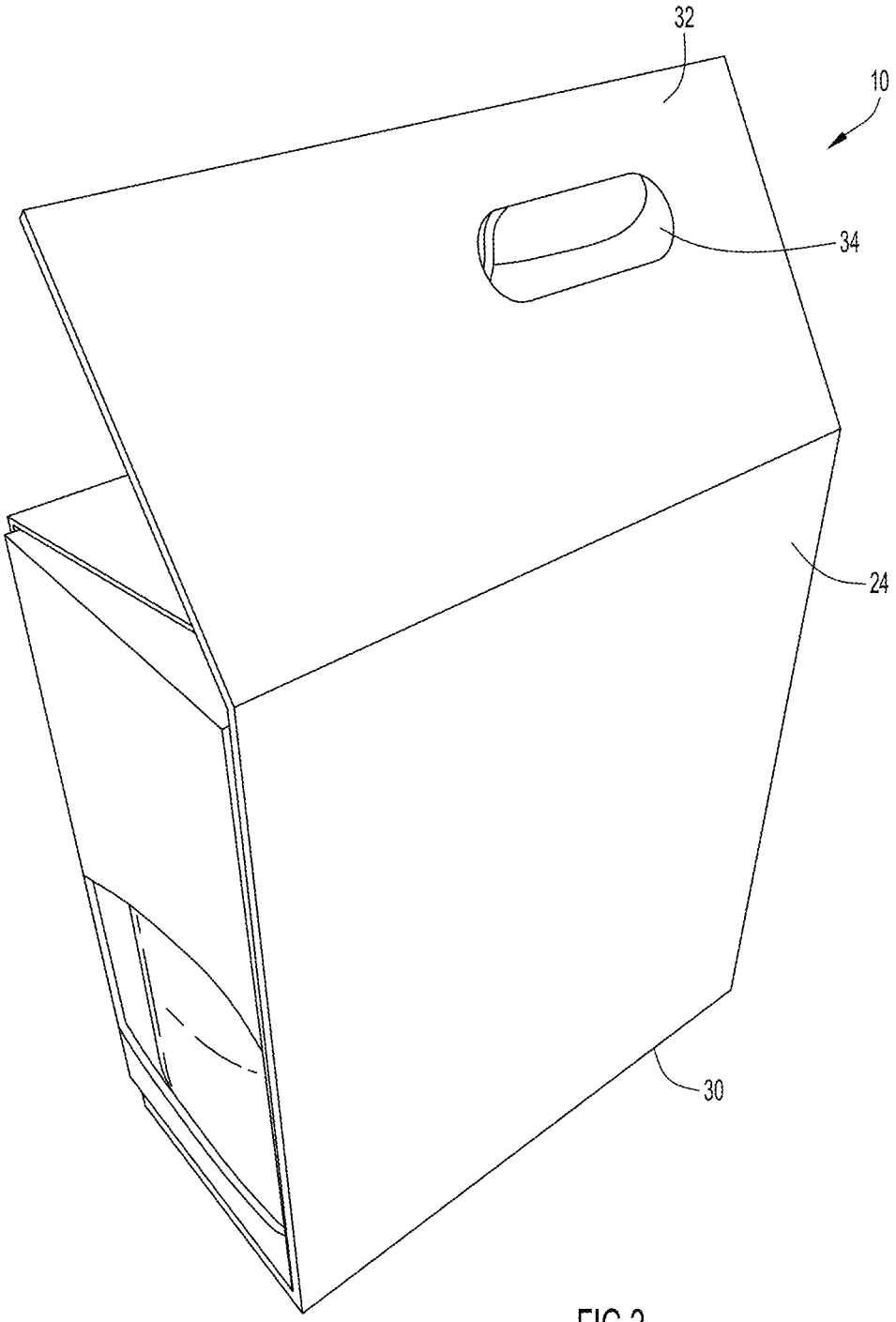
FIG. 2 is a different perspective view of the container illustrated in FIG. 1.

Referring to FIGS. 1 and 2, perspective views of an embodiment of a container according to the present invention are illustrated. The container 10 includes a housing 20, which in this embodiment, is formed of a cardboard material. As shown in FIG. 1, the housing 20 includes a front wall 22, a side wall 26, and a pair of top flaps 32 and 36 that have openings 34 and 38 for a user's hand, respectively. The openings 34 and 38 are configured to receive a user's hand to facilitate carrying the container 10. As shown in FIG. 2, container 10 also includes a rear wall 24 and a bottom wall 30. It is to be understood that the references to the various walls (i.e., as front or side, can vary in different descriptions of the container). The other components of the housing 20 are illustrated in other FIGS. in this application.

The housing 20 includes a main body portion 50 and a removable portion 52 that is coupled to the main body portion 50. The removable portion 52 has a lower edge 54 that defines an opening or window 40 formed in the side wall 26. As shown, a dispensing device 110 is located in the housing 20 and is viewable through the opening 40. In this embodiment, the dispensing device 110 is a spray bottle that includes a body 112 defining a chamber that is refillable by a user, as discussed below. In some embodiments, a cleaning solution or composition is located in the chamber of the body 112 when the dispensing device 110 is located in the housing 20. In other embodiments, the chamber of the body 112 is empty when the dispensing device 110 is located in the housing 20.

A series of perforations 56 are located along opposite side edges of the side wall 26. When a user grasps the side wall 26 adjacent to the lower end 54 and pulls upward and/or outward, the user can separate the removable portion 52 from the main body portion 50. When removable portion 52 has been separated, a user can access the dispensing device 110 for its initial use.

Figure 3:
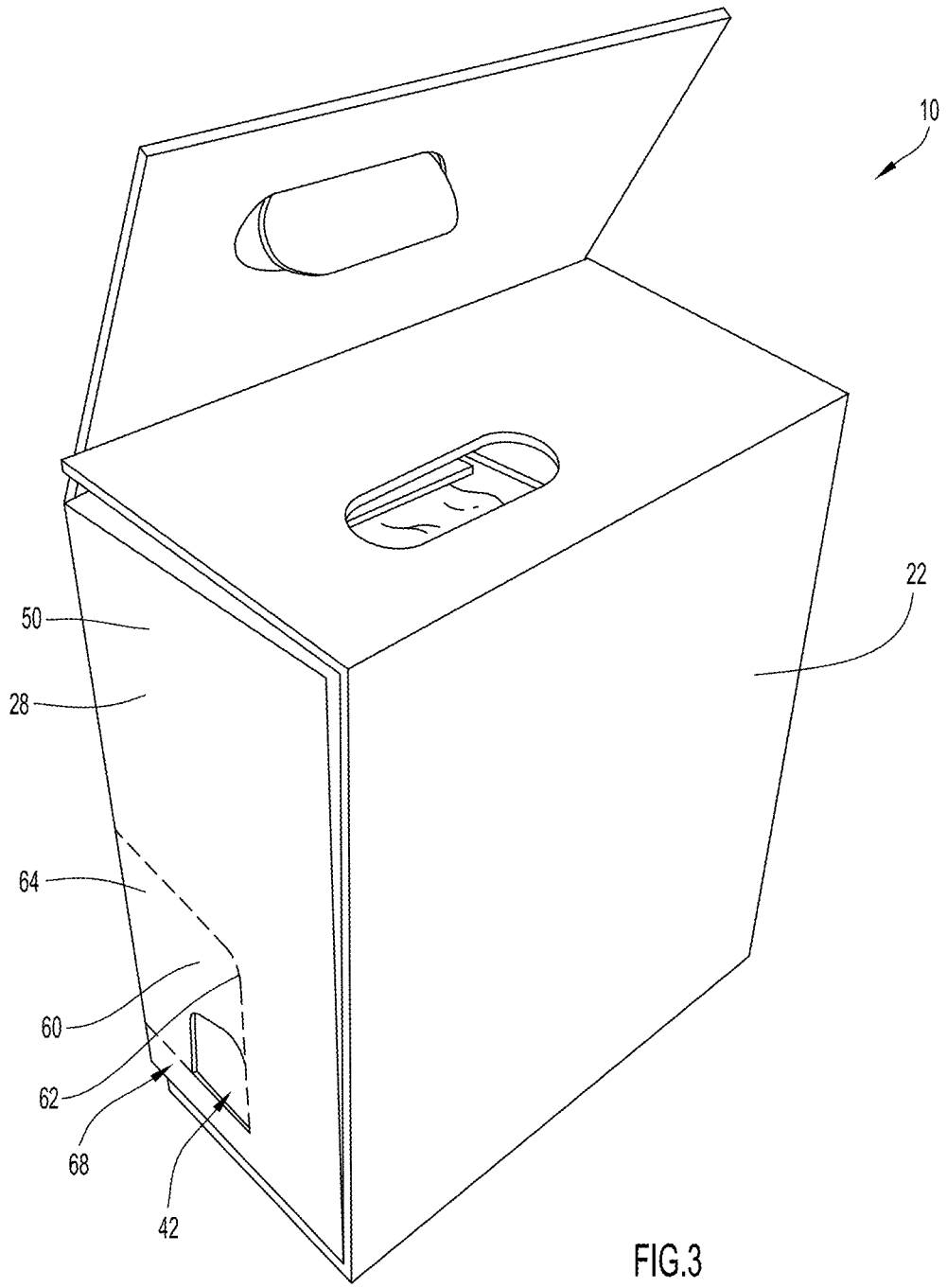
FIG. 3 is another perspective view of the container illustrated in FIG. 1 showing an opening formed in a side wall of the container.

Referring to FIG. 3, another perspective view of container 10 is illustrated. Container 10 includes a side wall 28 that has a portion that can be removed or pushed into the container 10 to form an opening 42 in the side wall 28. The opening 42 can be defined by a series of perforations that enable the portion of the side wall 28 to be removed. In addition, the side wall 28 includes an access portion or door 60 that is movably mounted to the side wall 28. The access portion or door 60 is defined by a series of perforations 62 that end at a hinge portion 64. In FIG. 3, the access door 60 is shown in its closed position 68. A user can separate part of access door 60 from the main body portion 50 and pivot the access door 60 to an opened position.

Figure 3A:
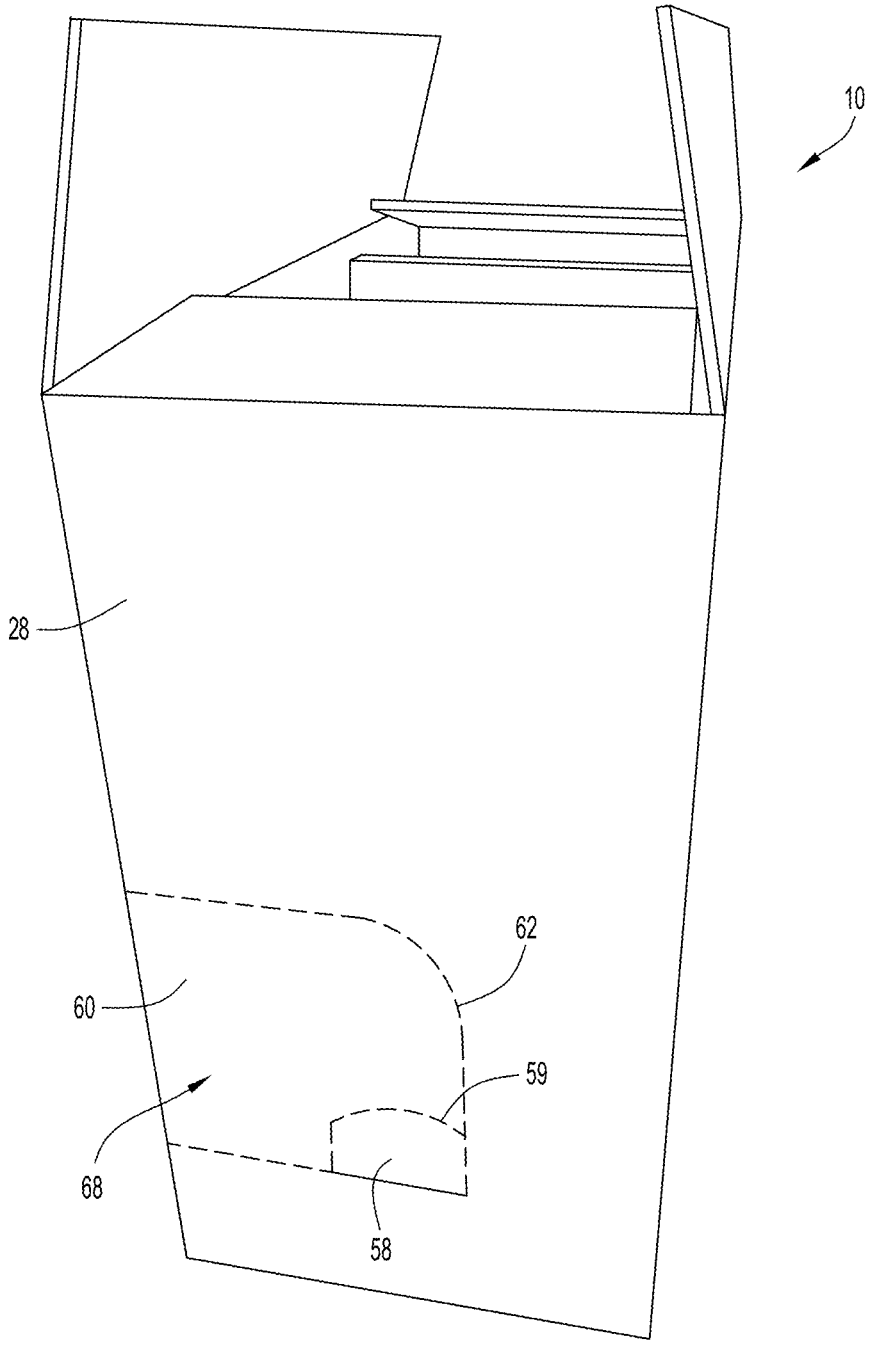
FIG. 3A is another perspective view of the container illustrated in FIG. 1 showing the access door and the small door in their closed positions.

Referring to FIG. 3A, the container 10 is illustrated in a configuration prior to the access door 60 being opened. The access door 60 is shown in its closed position 68. In this configuration, the wall 28 has a set of perforations 62 that define the access door 60, and a set of perforations 59 that define a smaller door 58. In this embodiment, the smaller door 58 is opened by a consumer initially separating the perforations 59 so that the consumer can grasp the access door 60 and open it by separating the perforations 62.

Figure 4:
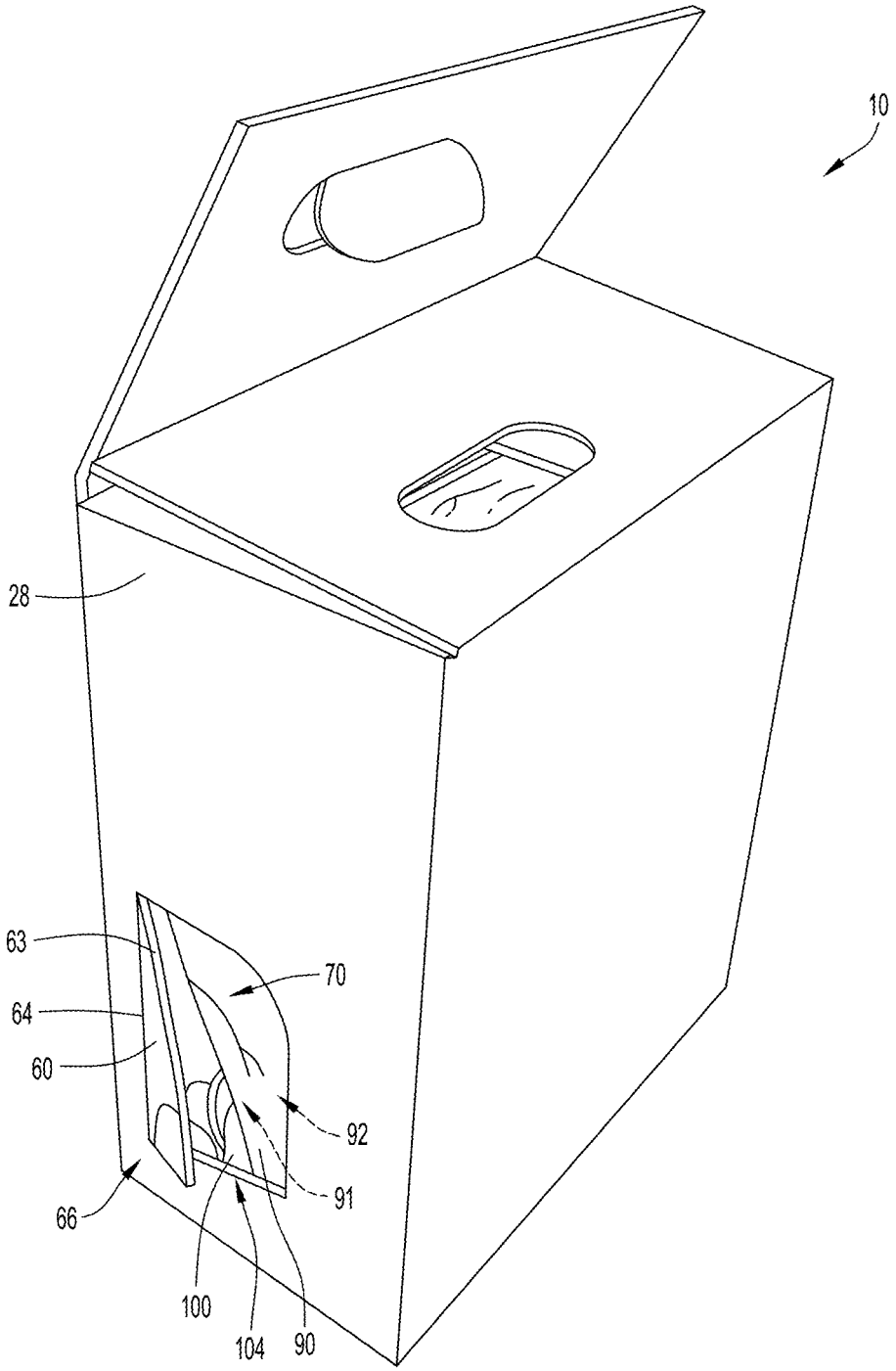
FIG. 4 is a perspective view of the container illustrated in FIG. 1 with an access portion or door moved to its opened position.

Turning to FIG. 4, a perspective view of container 10 is illustrated with the access door 60 moved to its opened position 66. As shown, the access door 60 has been separated in part along edge 63 from the main body portion 50 by way of the perforations 62. The access door 60 is moved about the hinge 64 to its opened position 66. When access door 60 is opened, a user can access the interior region 70 of the housing 20. As shown, a storage unit 90 is located in the interior region 70. In this embodiment, the storage unit 90 is a flexible bag that defines an interior volume or chamber 91. In other embodiments, the storage unit 90 may be a different shape or structure as long as the storage unit 90 defines an interior volume.

The storage unit 90 includes a composition 92 therein. In one embodiment, the composition is a bleach-based cleaning composition that can be sprayed from the dispensing device 110. For a storage unit 90 that can be used with a bleach-based cleaning composition 92, the material of the storage unit 90 is either a high-density polyethylene material or low-density polyethylene material. Ideally, the storage unit 90 has the ability to vent gases as needed while containing a bleach-based composition 92. In an alternative embodiment, the composition is a non-bleach-based cleaning composition. The materials that can be used for the storage unit 90 for a non-bleach-based composition 92 can vary.

Also shown in FIG. 4 is a release mechanism 100 that is coupled to the storage unit 90. The release mechanism 100 is illustrated in its retracted position 104. The release mechanism 100 and the storage unit 90 are stored in the interior region 70 of the housing 20 when the access door 60 is in its closed position 68 initially. When the access door 60 is moved to its opened position 66, a user can access the release mechanism 100 and move it relative to the housing 20.

Figure 4A:
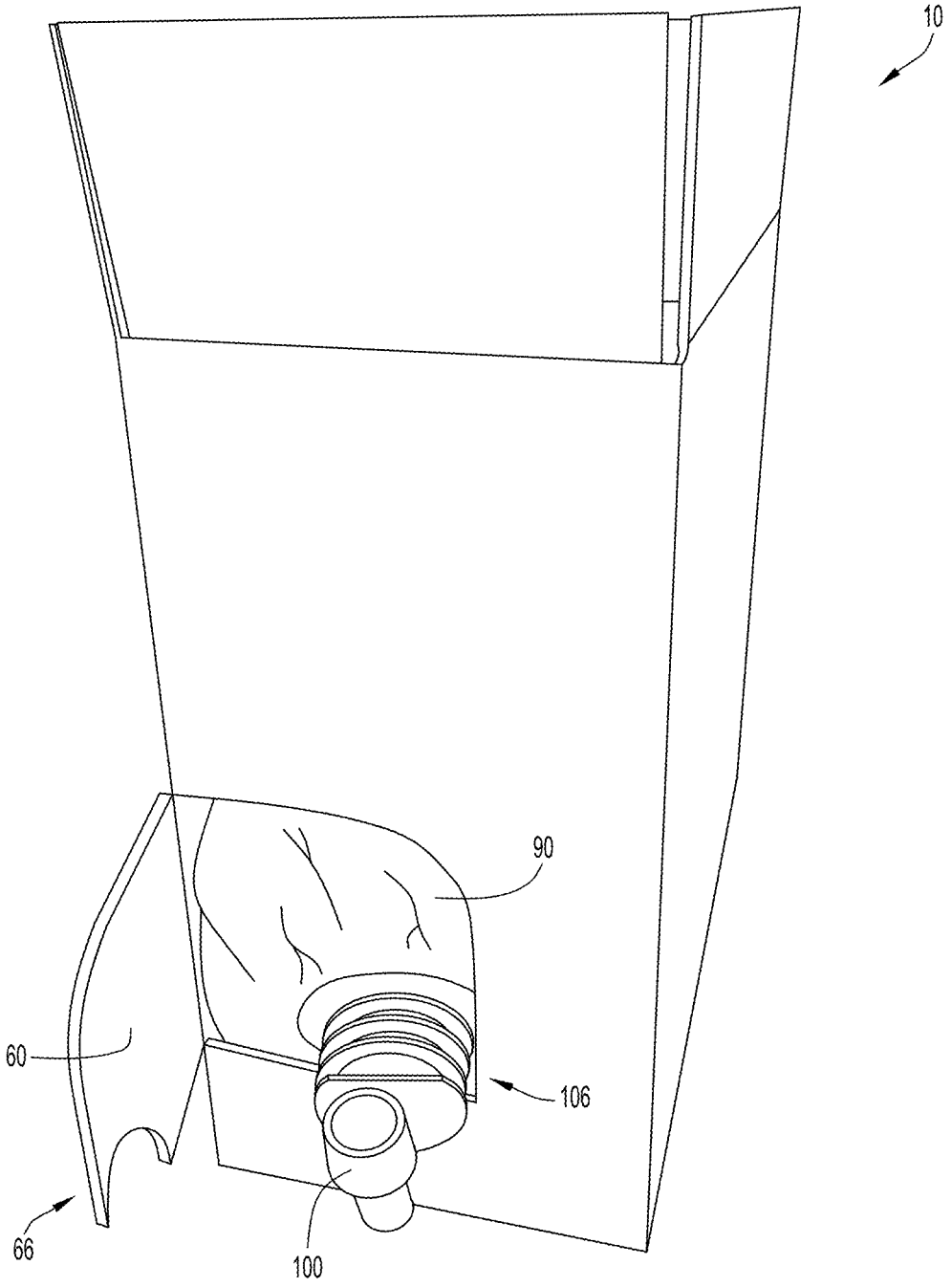
FIG. 4A is another perspective view of the container illustrated in FIG. 4 with its access portion opened and a release mechanism moved to its extended position.

Turning to FIG. 4A, the access door 60 is illustrated as being opened to position 66 and the release mechanism 100 has been moved to its outer or extended position 106. In this position, the release mechanism 100 extends through the opening in the housing 20 that is created by the access door 60 being opened. The storage unit 90 is visible through that opening, and is connected to the release mechanism 100.

Figure 5:
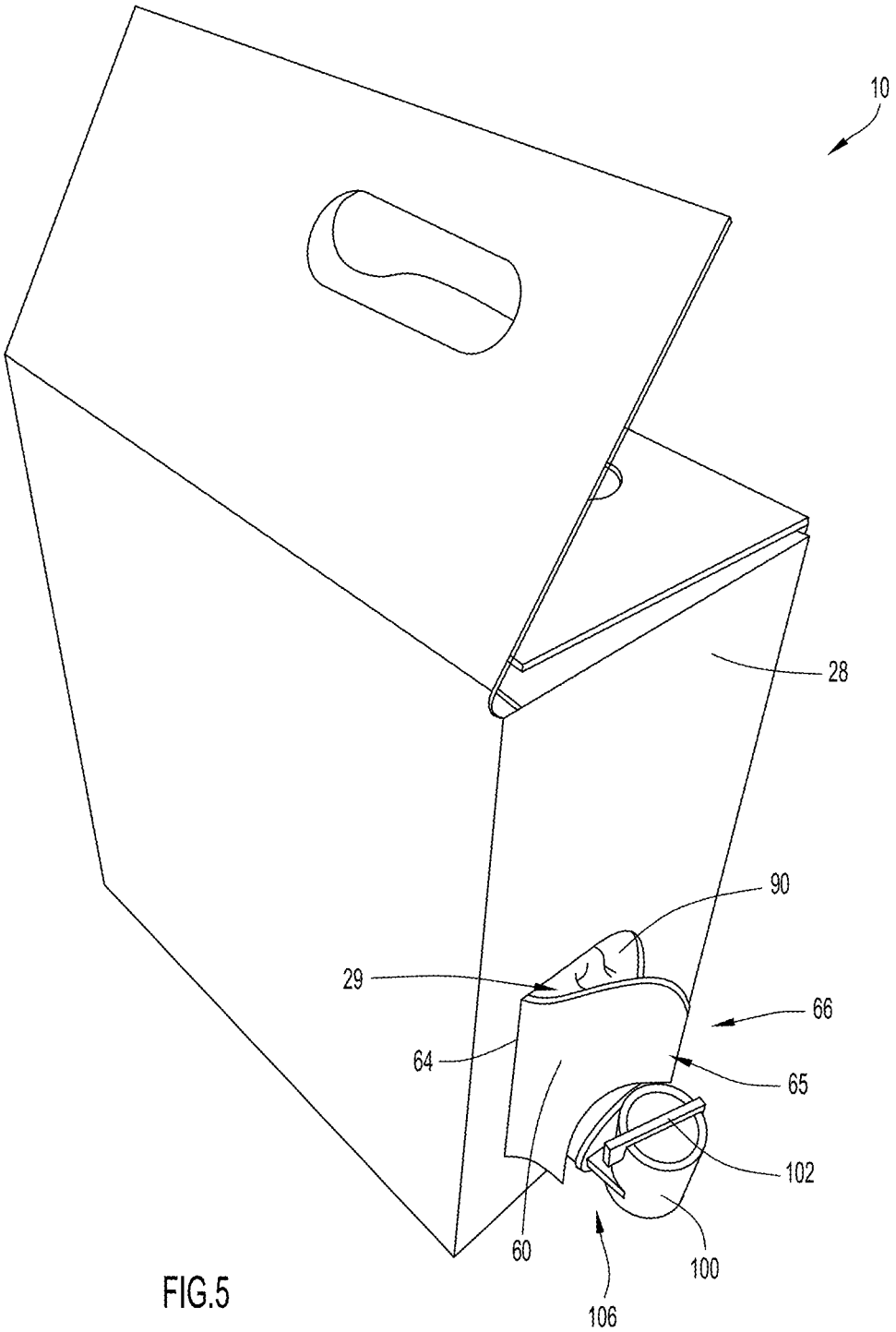
FIG. 5 is a perspective view of the container illustrated in FIG. 1 with a release mechanism moved to its extended position.
Figure 6:
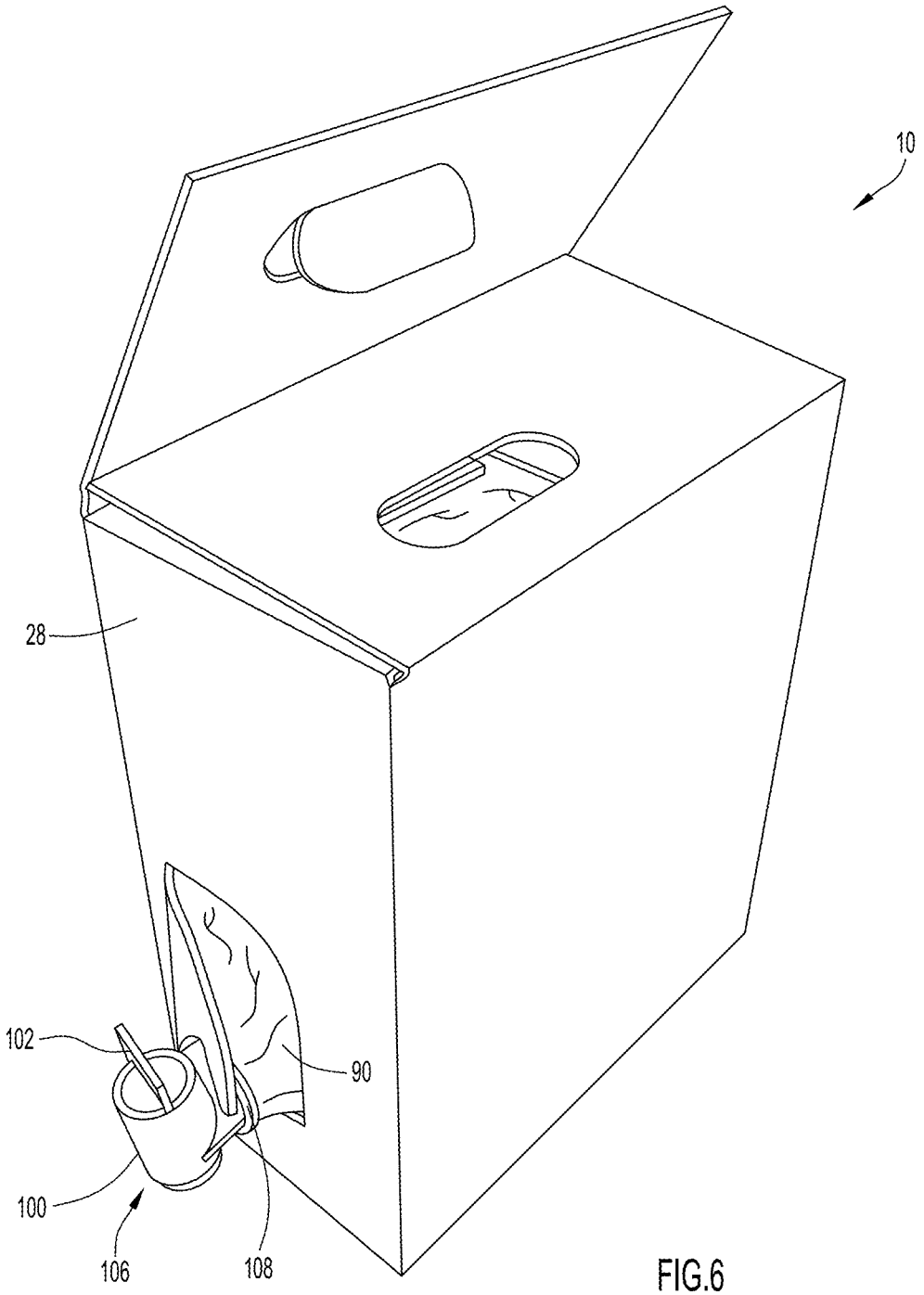
FIG. 6 is another perspective view of the container illustrated in FIG. 5 showing the release mechanism in its extended position.

Turning to FIGS. 5 and 6, perspective views of the container 10 are illustrated with the release mechanism 100 disposed in its extended position 106 relative to the housing 20. The release mechanism 100 can be manipulated so that it extends outwardly from the housing 20 through opening 29. In this embodiment, the release mechanism 100 includes an actuator 102 that can be manipulated to open the release mechanism 100 and allow a composition 92 in the storage unit 90 to exit the storage unit 90 and pass through the release mechanism 100. FIG. 6 shows a coupler 108 by which the release mechanism 100 is connected to the storage unit 90.

Referring to FIG. 5, the access door includes indicia 65 that indicate to a user the relative positions and/or directions of movement of the actuator 102 to open and close the release mechanism 100, thereby preventing or allowing the release of the composition 92 as desired.

In this embodiment, the actuator 102 is a pivotally mounted lever that can be manipulated or rotated by a user about a substantially vertical axis to open the release mechanism. In other embodiments, the release mechanism 100 can have different actuators, such as a push button, a movably mounted handle, or a pivotally mounted lever that moves about an axis other than a vertical axis. In other embodiments, the release mechanism can be any form of a spigot.

The release mechanism 100, including the actuator 102, is formed of a plastic material. For a container 10 in which a bleach-based composition 92 is in the storage unit 90, the material used for the release mechanism 100 and actuator 102 has to be able to withstand the effects of the composition 92.

Figure 7:
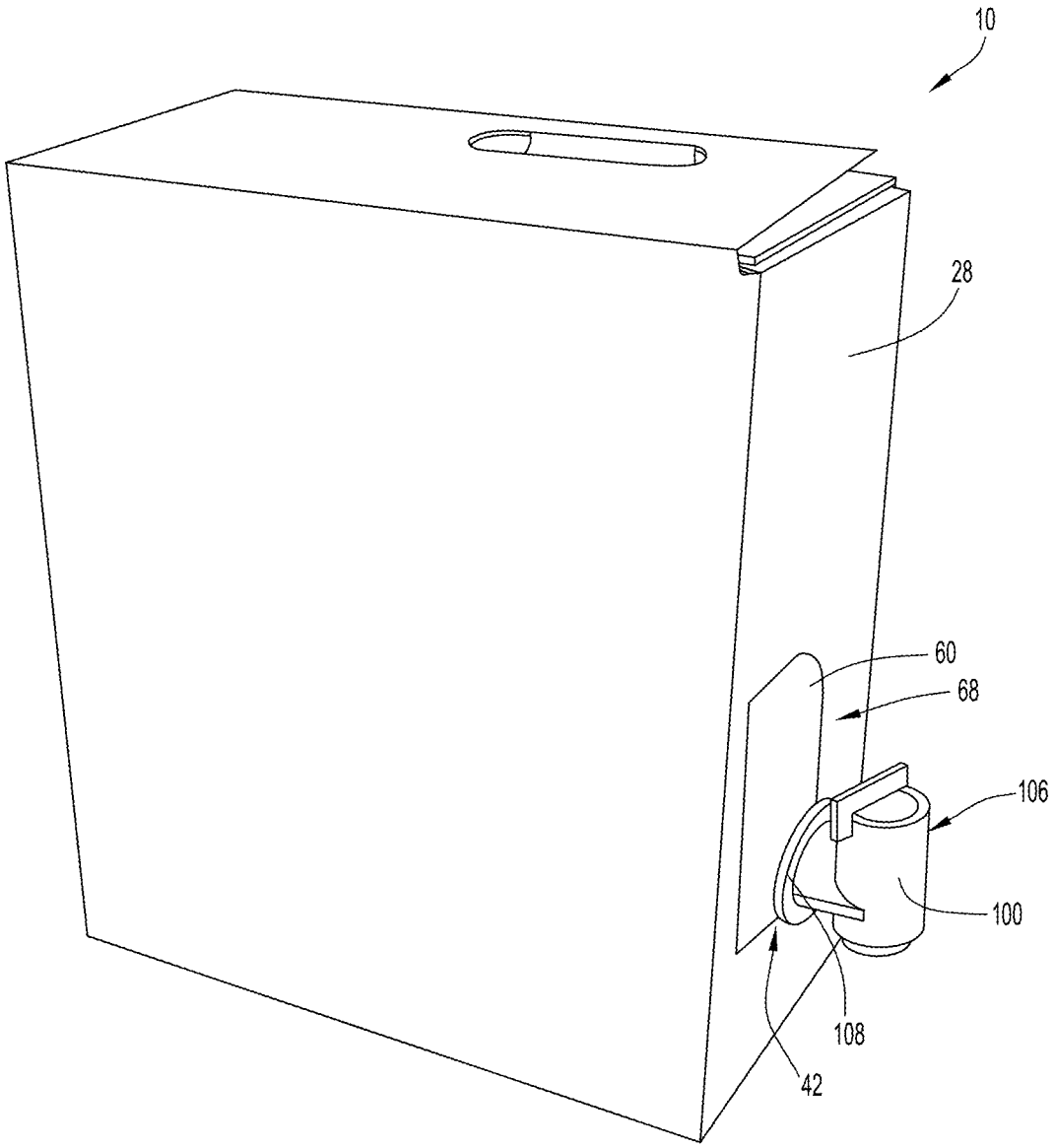
FIG. 7 is another perspective view of the container illustrated in FIG. 5 showing the release mechanism in its extended position.

Turning to FIG. 7, another perspective view of the container 10 is illustrated. As shown, the release mechanism 100 is disposed in its extended position 106 and the access door 60 has been moved back to its closed position 68. As a result, the release mechanism 100, including its coupler 108, extend through dispensing opening 42 in side wall 28 and are accessible outside of housing 20.

Figure 7A:
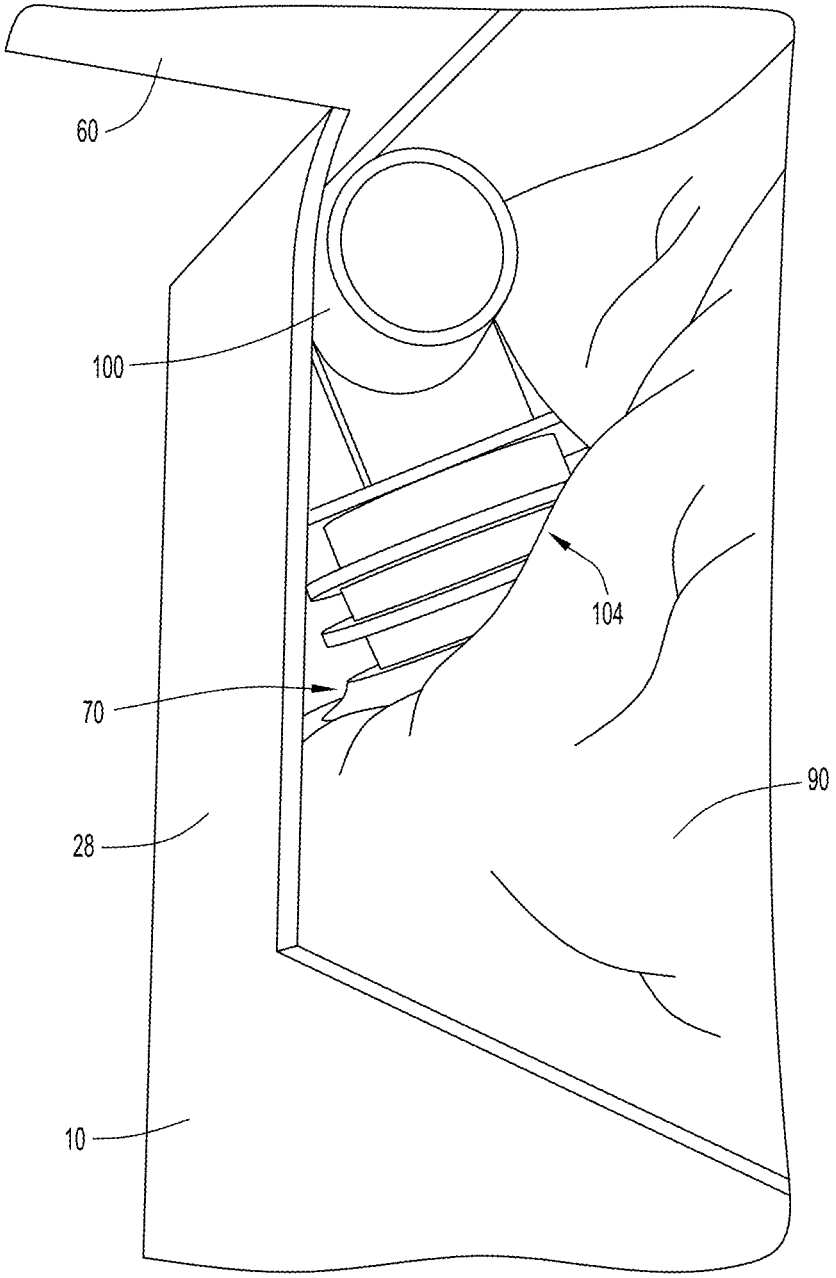
FIG. 7A is a view of the container illustrated in FIG. 5 showing the release mechanism in its retracted position.

Referring to FIG. 7A, a portion of the interior region 70 of the container 10 is illustrated. The interior region 70 contains the storage unit 90 and the release mechanism 100 that is moved to a retracted position 104. In this embodiment, wall 28 contains the release mechanism 100 in the interior region 70.

Figure 8:
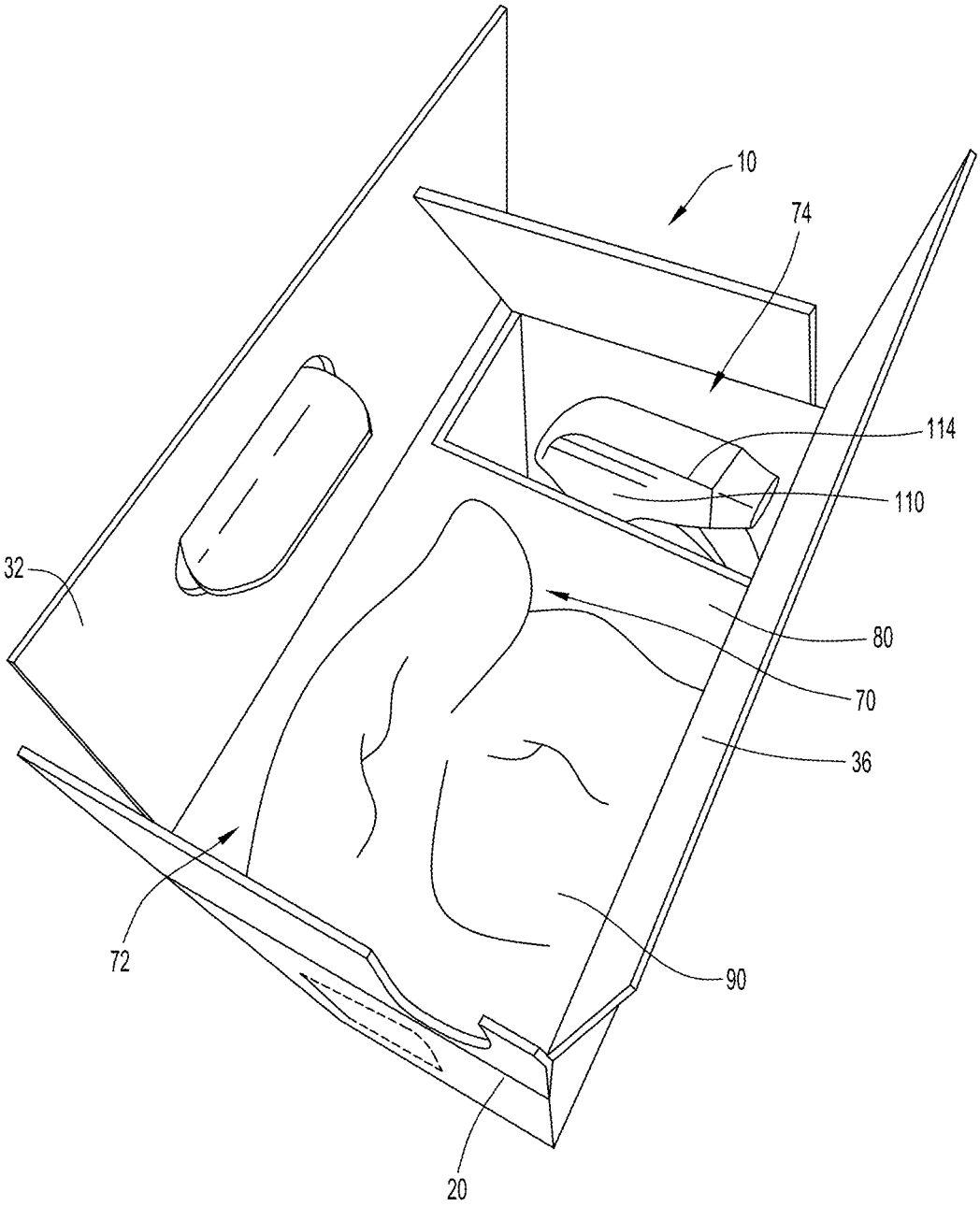
FIG. 8 is a top perspective view of the container illustrated in FIG. 1 showing the interior region of the container.
Figure 9:
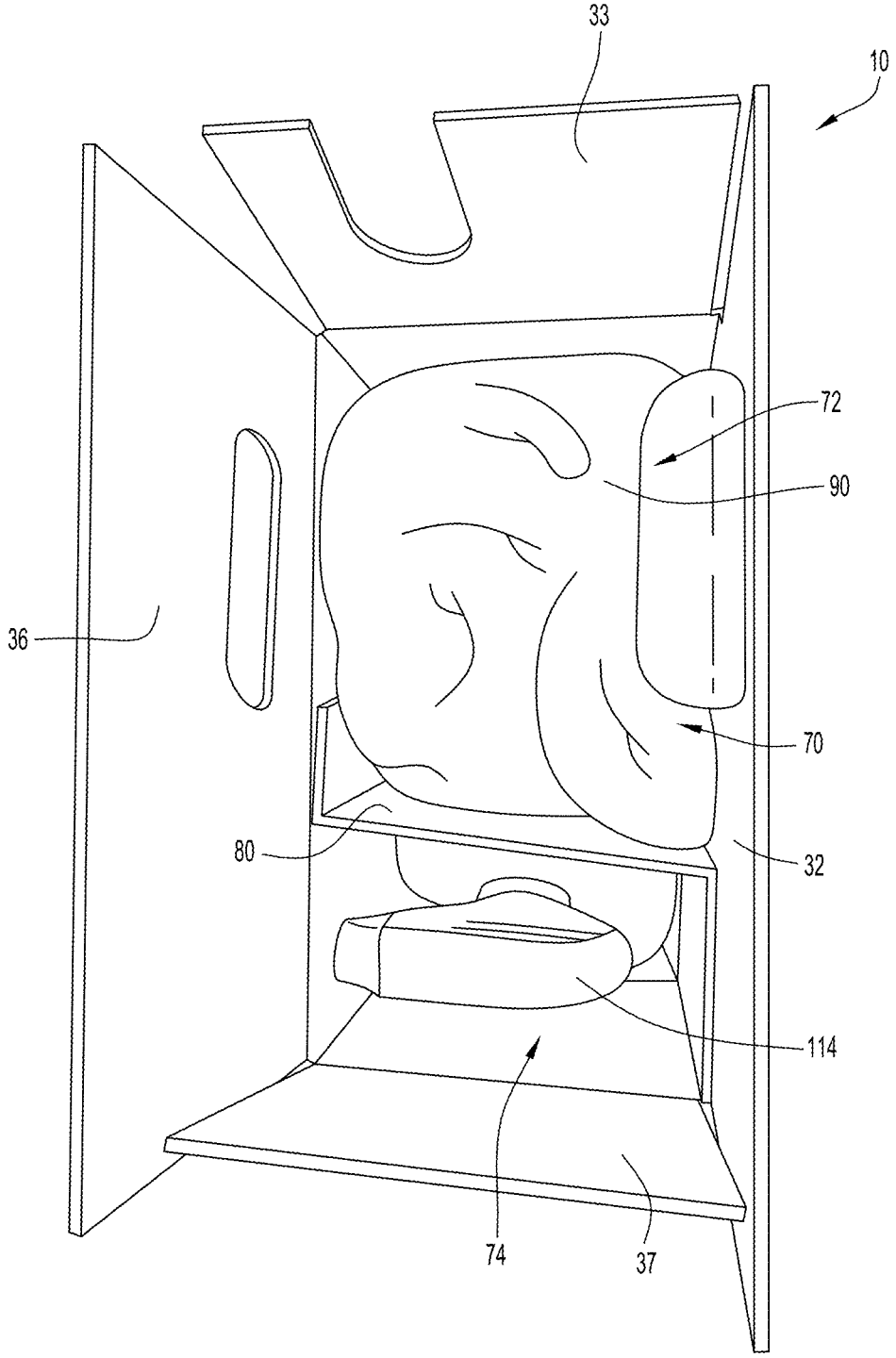
FIG. 9 is another perspective view of the container illustrated in FIG. 8.

Referring to FIGS. 8 and 9, different top perspective views of the container 10 are illustrated. The housing 20 of the container 10 defines an interior region 70. The interior region 70 is accessible when the first top flap 32 and the second top flap 36 are opened and the first top side flap 33 and the second top side flap 37 (see FIG. 9) are opened.

The interior region 70 defines a cavity or receptacle in which the storage unit 90 and the dispensing device 110 are located. In one embodiment, the dispensing device 110 includes a spray head or spraying mechanism 114 that is coupled to the body 112, and that can be actuated by a user to spray or distribute externally the composition located in the body 112. In an alternative embodiment of the invention, the dispensing device 110 may include a closure including but not limited to: a cap, a child-resistant closure, a spout, a dosing cap, or any other suitable closure for said dispensing device.

In the illustrated embodiment, the housing 20 includes a barrier or partition 80 that splits the interior region 70 into two different interior region portions 72 and 74. As shown, the storage unit 90 is located in first interior region portion 72, and the dispensing device 110 is located in second interior region portion 74. In different embodiments, the sizes of interior region portions 72 and 74 relative to each other can vary. In FIGS. 8 and 9, the second interior region portion 74 is selected to be approximately the same perimeter and size as the dispensing device 110, and the first interior region portion 72 is the remainder of the housing 20. Thus, the size of the first interior region portion 72 can vary depending on the size of the storage unit 90. The size of the storage unit 90 can vary depending on the desired amount of composition 92. In one embodiment, the storage unit 90 is sized to accommodate and hold between a half of a gallon and five gallons of composition 92. In another embodiment, the storage unit 90 is more preferably sized to accommodate and hold between a half of a gallon and three gallons of composition 92.

The volume of storage unit 90 is greater than the volume of the chamber defined by body 112 of dispensing device 110. As a result, when a user has used the composition 92 in dispensing device 110, the user can refill the dispensing device 110 with composition 92 from storage unit 90 by using the release mechanism 100 multiple times.

Figure 10:
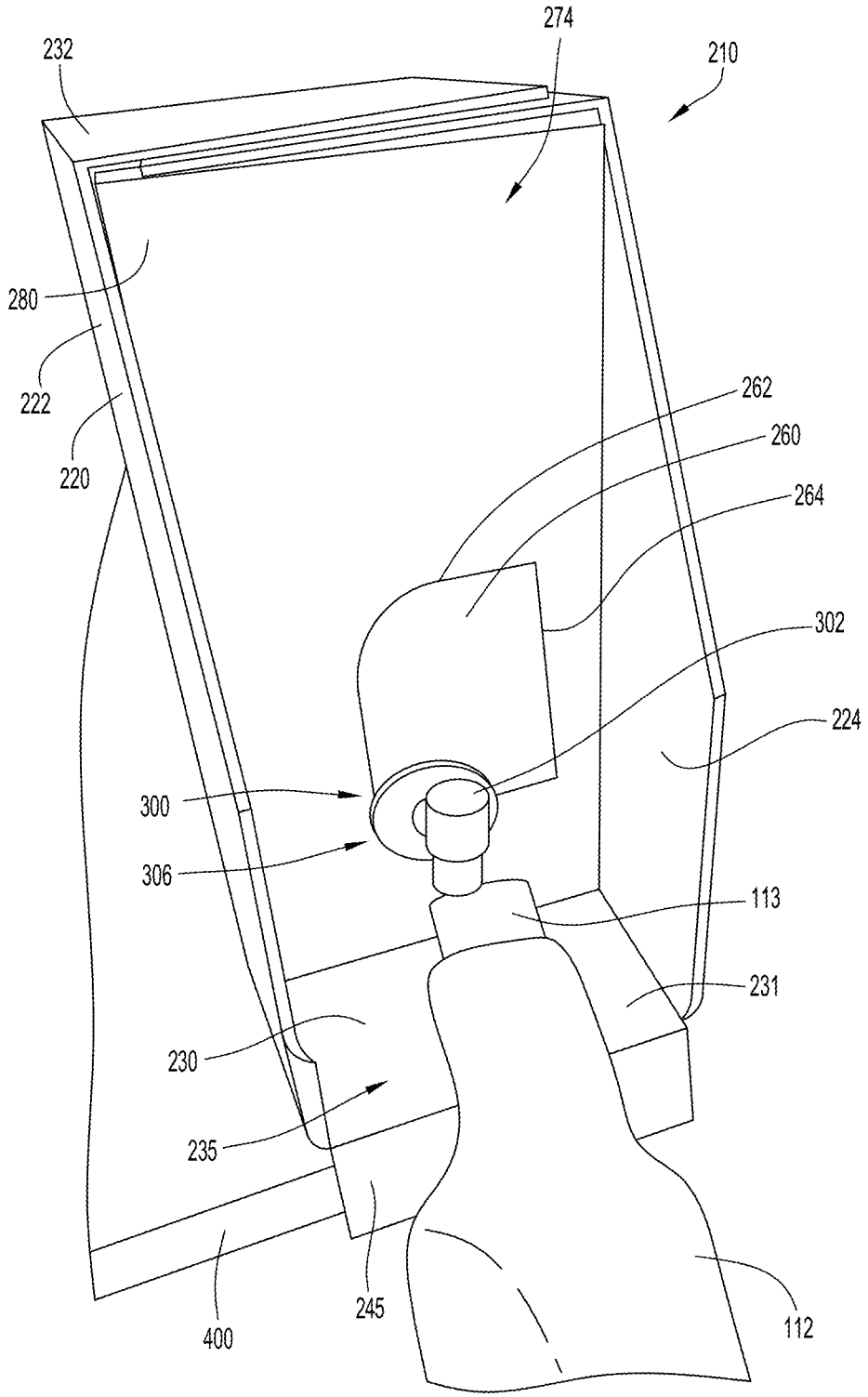
FIG. 10 is a perspective view of another embodiment of a container that is being used to refill a dispensing device according to the present invention.

Referring to FIG. 10, a perspective view of another embodiment of a container according to the present invention is illustrated. In this embodiment, the container 210 includes a housing 220 with a front wall 222, a rear wall 224, a top flap or wall 232, and a bottom wall 230. A portion of the housing 220 has been separated and removed from the front wall 222 and the rear wall 224, thereby providing a user with access to interior region portion 274 which is defined in part by barrier or partition 280.

Formed in barrier 280 are several perforations 262 that define an access portion or door 260. Similar to access door 60 in housing 20, access door 260 is pivotally mounted on a hinge 264 that does not contain any perforations 262. After opening access door 260, a user can move the release mechanism 300, which is coupled to a storage unit on the other side of barrier 280, through the opening formed by the access door 260. Once the release mechanism 300 is placed in its extended position 306 (as shown in FIG. 10), the access door 260 can be moved to its closed position. A user can manipulate the actuator 302 to allow composition in the storage unit of container 210 to pass through the release mechanism 300.

In this embodiment, the release mechanism 300 is located for use in the interior of the housing 220 instead of extending outwardly from an exterior of the housing, which is how release mechanism 100 for housing 20 is positioned for its use. A user can hold a dispensing device or bottle 110 to be refilled so that the neck portion 113, which contains an opening into the chamber of the body 112, is below the release mechanism 300, as shown in FIG. 10. When the actuator 302 is manipulated, the composition is directed into the body 112. Once the body 112 is filled, the spraying mechanism 114 can be mounted to the neck portion 113, and the dispensing device 110 can be used again.

By locating the release mechanism 300 in an opening in the barrier 280, a drip pan or spill area 235 is formed on the inner surface 231 of the bottom wall 230. A distal portion 245 of the side wall that is moved from the main portion of housing 220 still remains coupled to the main portion and can be folded downwardly as shown in FIG. 10 and placed proximate to the end of a support 400. Thus, when a user is refilling a dispensing device 110, any composition that spills will contact the drip pan area 235 and can be moved over the edge of the distal portion 245, when desired.

Figure 11:
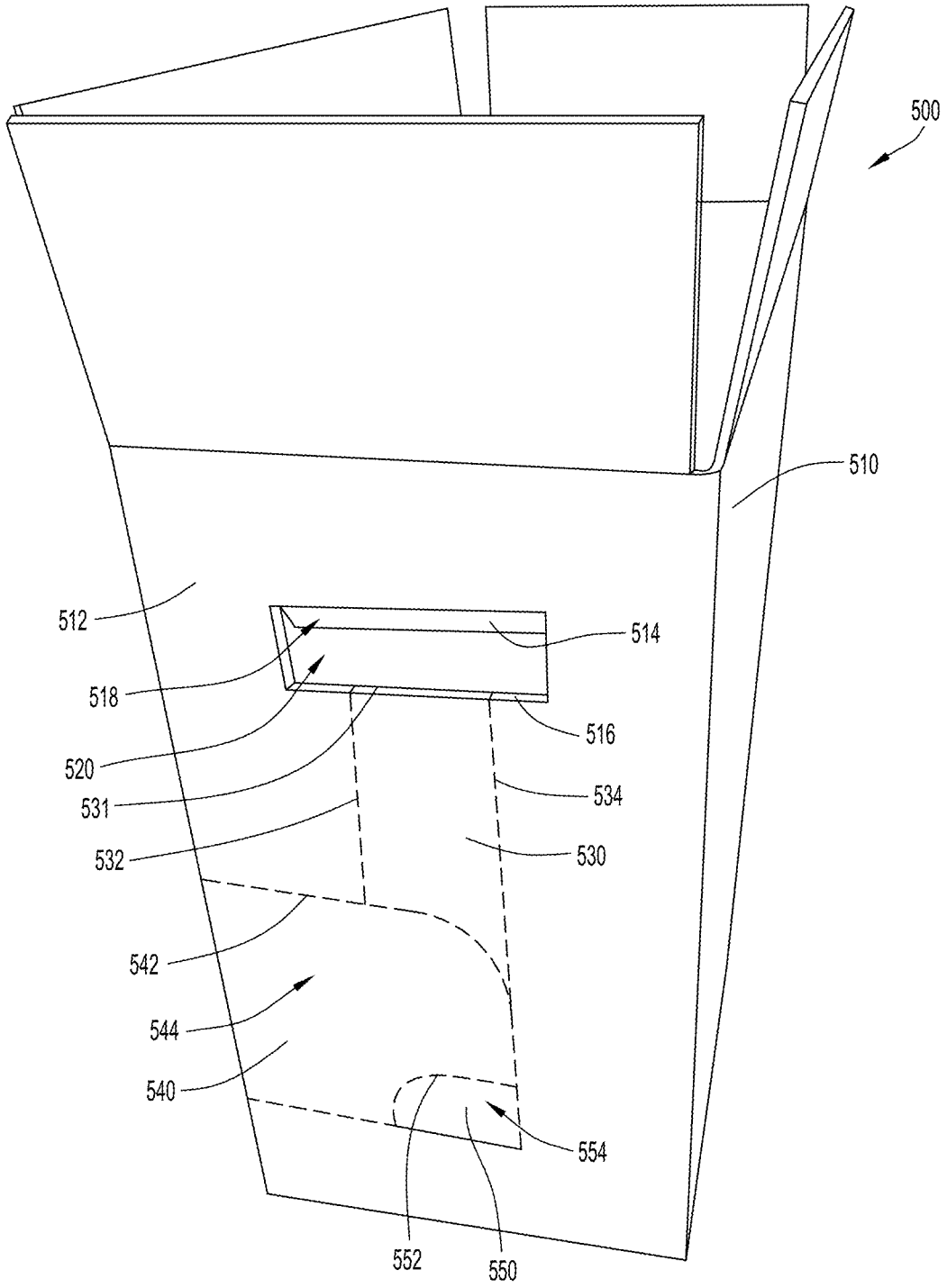
FIG. 11 is a perspective view of an alternative embodiment of a container.

Referring to FIGS. 11-20, an alternative embodiment of a container is illustrated. Turning to FIG. 11, container 500 includes a housing 510 that has several walls, of which wall 512 is visible in this view. Wall 512 includes a handle portion 514 that is coupled to an edge 516 with several perforations that can be separated to move the handle portion 514 to its inner position 518 to form the opening 520. A user can insert a hand into the opening 520 to lift and move the container 500.

In this embodiment, the container 500 includes a removable portion 530 with an upper end 531 and which is defined laterally by two sets of perforations 532 and 534 on opposite sides. The upper end 531 may be referred to alternatively as a top end. In FIG. 11, the removable portion 530 has not been removed from wall 512 yet. The container 500 has a pivotally mounted access portion or door 540 that is initially coupled to the wall 512 via perforations along edge 542. The door 540 is shown in its closed position 544. The container 500 also has a small door 550 that is shown in its closed position 554 and initially coupled to the wall 512 and the access door 540 via perforations along edge 552.

Figure 12:
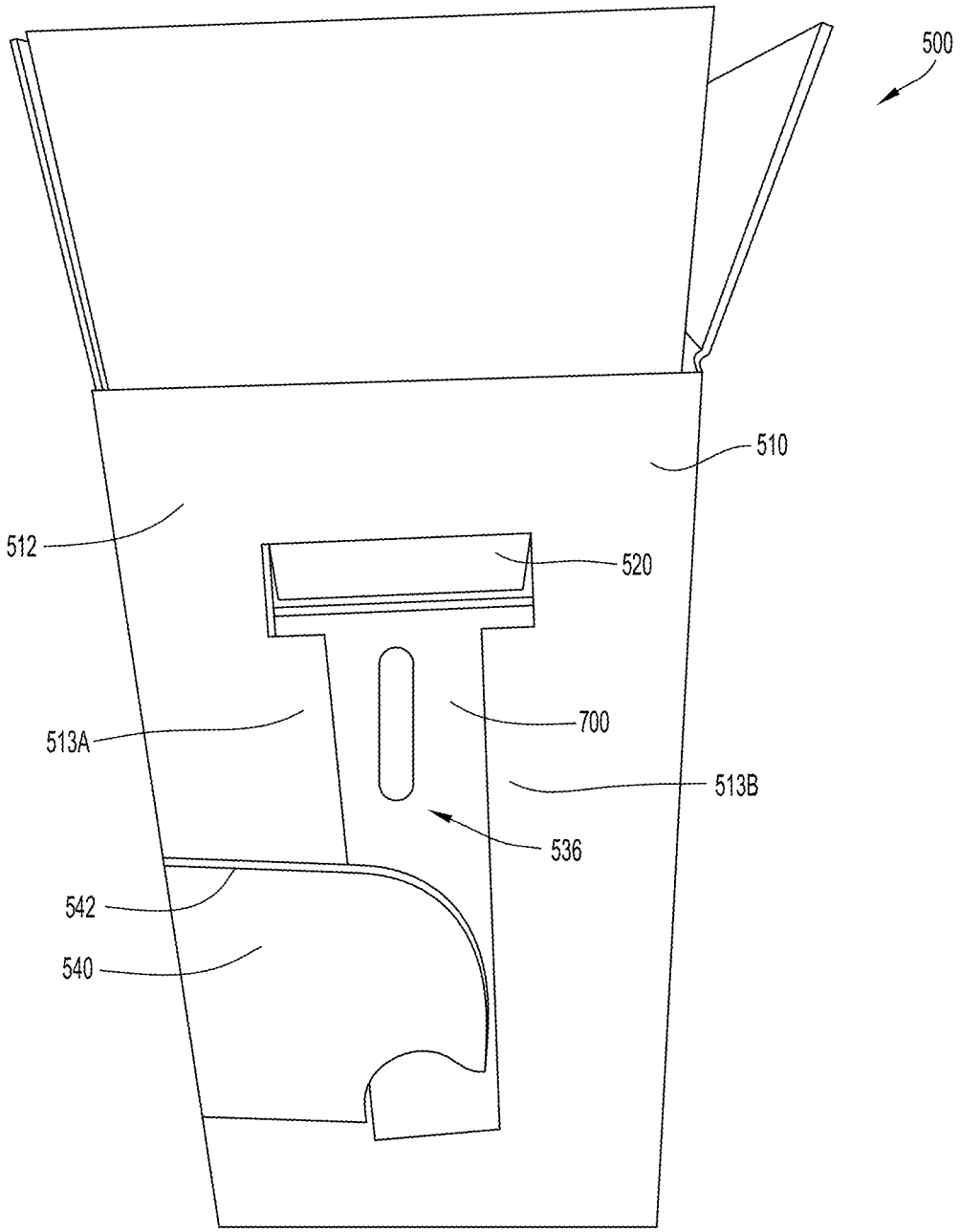
FIGS. 12-15 are different end views of the container illustrated in FIG. 11 shown in different configurations.
Figure 13:
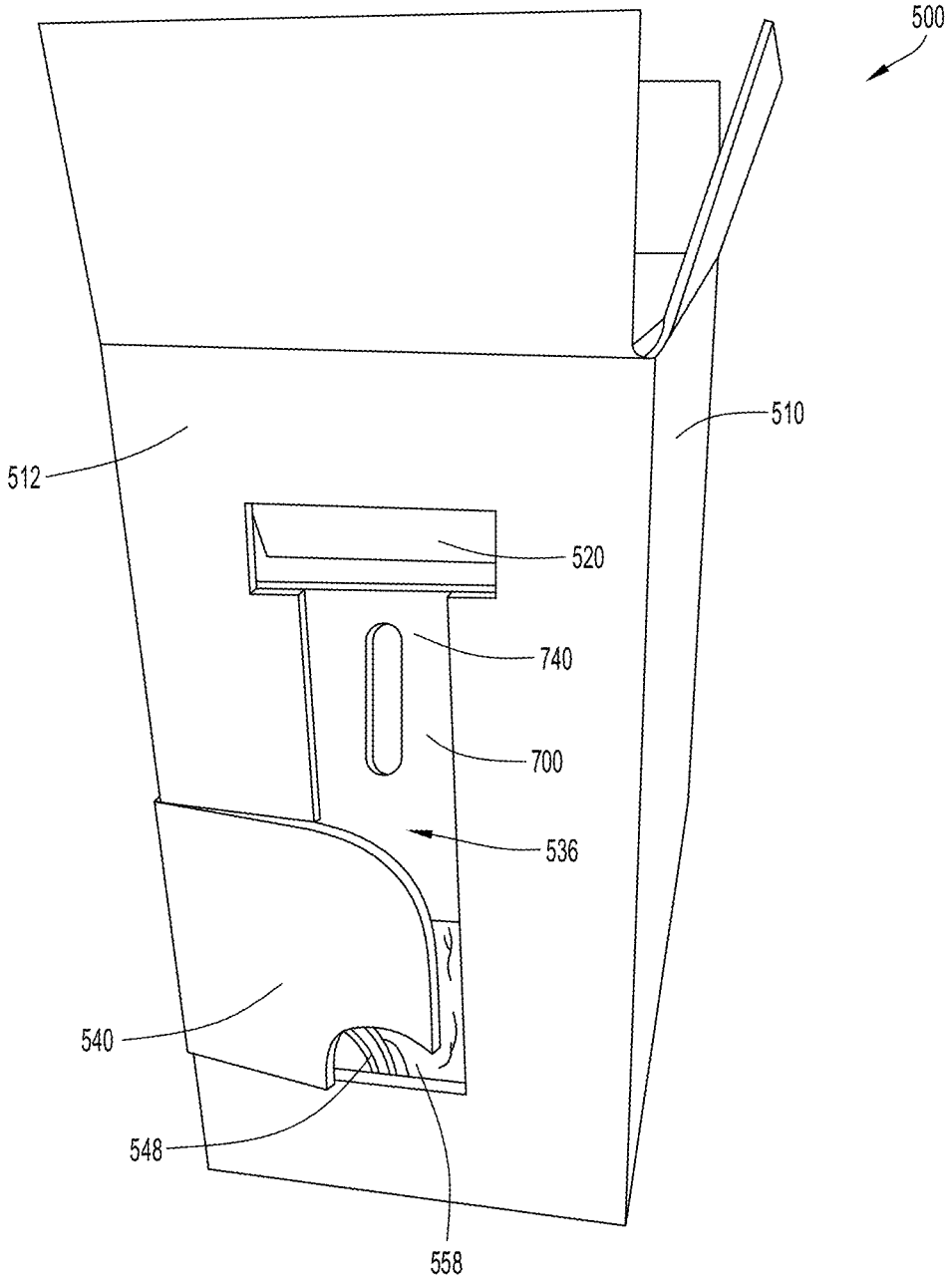

Referring to FIGS. 12 and 13, the container 500 is illustrated with the removable portion 530 removed or separated from the wall 512 of the housing 510. Initially turning to FIG. 12, to separate the removable portion 530, a user can insert a hand into the handle opening 520 and grasp the upper end 531 of the removable portion 530. The user can pull the removable portion 530 to break the perforations 532 and 534 to separate the removable portion 530 from the housing 510. When the removable portion 530 has been separated from the housing 510, an opening 536 in the wall 512 is formed. The opening 536 can be referred to alternatively as a wall opening 536. The width of the opening 536 is defined by the surfaces with perforations 532 and 534 (see FIG. 11) that are located along the edges of wall portions 513A and 513B (see FIG. 12), respectively. The opening 536 extends from an upper end located at a handle opening 520 to a lower end located adjacent to the edge 542 of the access door 540 in its closed position 544. The handle opening 520 can be referred to alternatively as a handle portion opening. The opening 536 extends through the housing 510 from an exterior of the housing 510 to an interior of the housing 510. Also, the wall opening 536 is in communication with the handle opening 520, which means that the openings 520 and 536 form a continuous opening together.

In this embodiment, container 500 includes an inner panel 700 that is located adjacent to the opening 536. The details of the inner panel 700 are described in greater detail below. As shown in FIG. 12, the inner panel 700 is positioned so that the contents (such as a storage unit) in the interior region of the housing 510 do not pass through the opening 536 and out of the housing 510. The inner panel 700 is sized and positioned to span the gap or opening between the opposing edges of wall portions 513A and 513B of the wall 512.

Turning to FIG. 13, the vertical distance of a portion 740 of the inner panel 700 is illustrated. In this embodiment, the inner panel portion 740 extends from a location adjacent to the handle portion opening 520 to a location behind the access door 540. Thus, the inner panel portion 740 blocks a majority of the length of the opening 536. In FIG. 13, the opening 558 that is formed when the small door 550 has been removed can be seen. The opening 558 is defined by the recess or notch 548 in the access door 540 where small door 550 was located.

Figure 14:
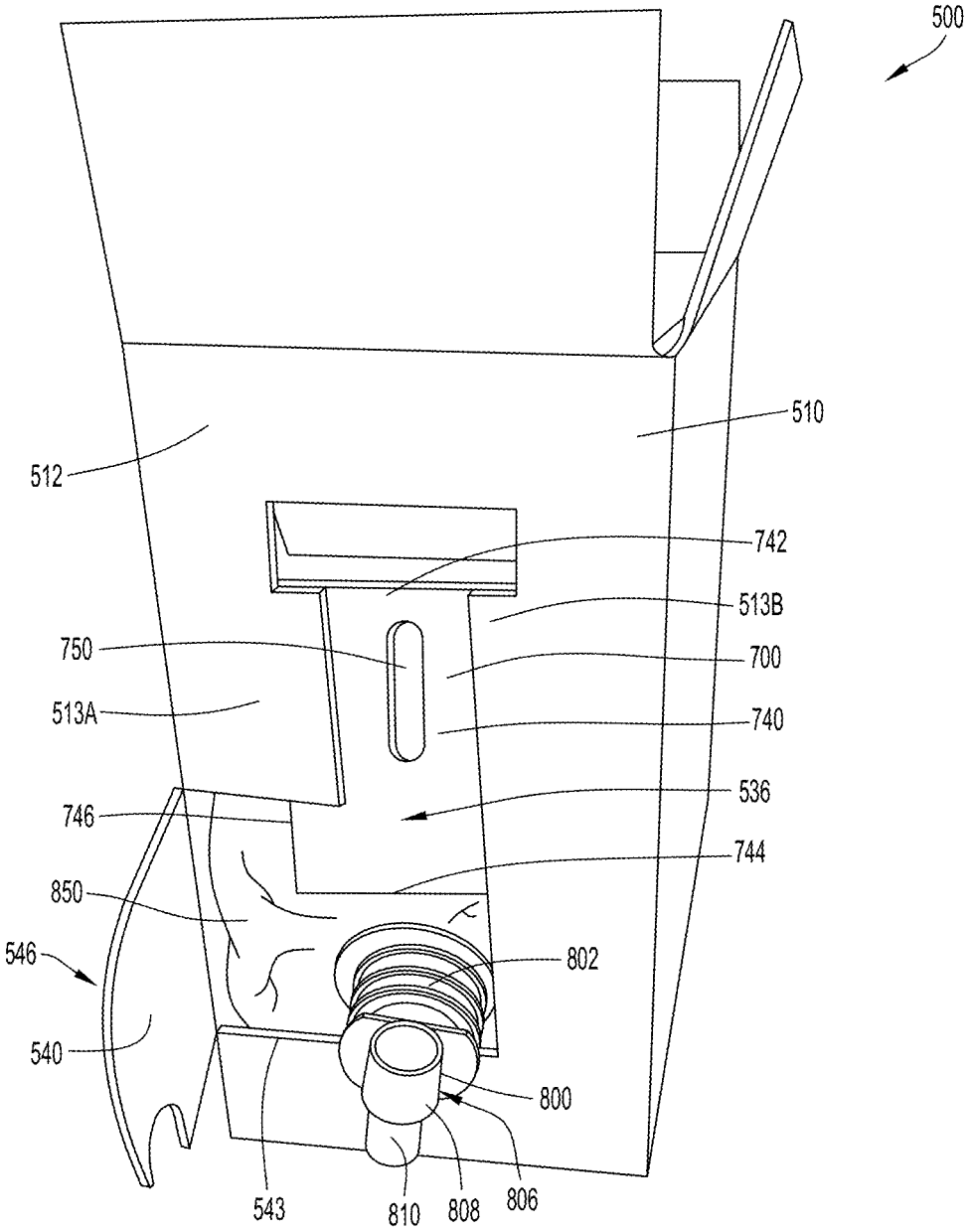

Referring to FIG. 14, the access door 540 has been moved to its opened position 546, which permits a user to access the interior of the housing 510. When the access door 540 has been opened, the lower edge 543 defining part of the opening is shown. In addition, the portion 740 of the inner panel 700 is shown blocking the opening 536. In this embodiment, the inner panel portion 740 has an upper edge or end 742, an opposite lower edge or end 744, and a distal edge or end 746. The distal edge 746 is located so that it is behind or inside of wall portion 513A and behind or inside of wall portion 513B. By spanning the full width of the opening 536 and being inside of both wall portion 513A and wall portion 513B, the inner panel portion 740 blocks the storage unit 850 from moving through the opening 536 or extending out of the housing 510.

In one embodiment, the container 500 can have a through hole that is positioned so that a user can view the level of contents remaining in the storage unit 850 in the container 500. By viewing the content level, the user can determine whether a refill of the contents is needed. In FIG. 14, a through hole or opening 750 for viewing the contents level is formed in the inner panel 700. In other embodiments, the through hole 750 can be located in a different part of the housing 510. Also, in different embodiments, the through hole 750 may have any suitable shape and size that allows a consumer to look through the hole 750 to view the product in the container 500.

Coupled to the storage unit 850 is a release mechanism 800 that can be used by a user to dispense contents from the storage unit 850. The release mechanism 800 includes a body 802 that is secured or coupled to the storage unit 850. In one embodiment, the storage unit 850 is a flexible bag that is made of one or more materials that can withstand the effects of the contents in the storage unit 850. The body 802 of the release mechanism 800 can be welded, adhered or otherwise coupled to the storage unit 850.

The release mechanism 800 includes a dispensing portion 806 with an actuator 808 that can be manipulated by a user to open a valve or closure to permit contents to flow through the release mechanism 800 and out through an outlet or port 810. When the access door 540 is opened, a user can move the release mechanism 800 to a position similar to that shown in FIG. 14 to position the outlet 810 outside of the housing 510. Once the release mechanism 800 is moved to the position shown in FIG. 14, the access door 540 can be moved back to its closed position.

Figure 15:
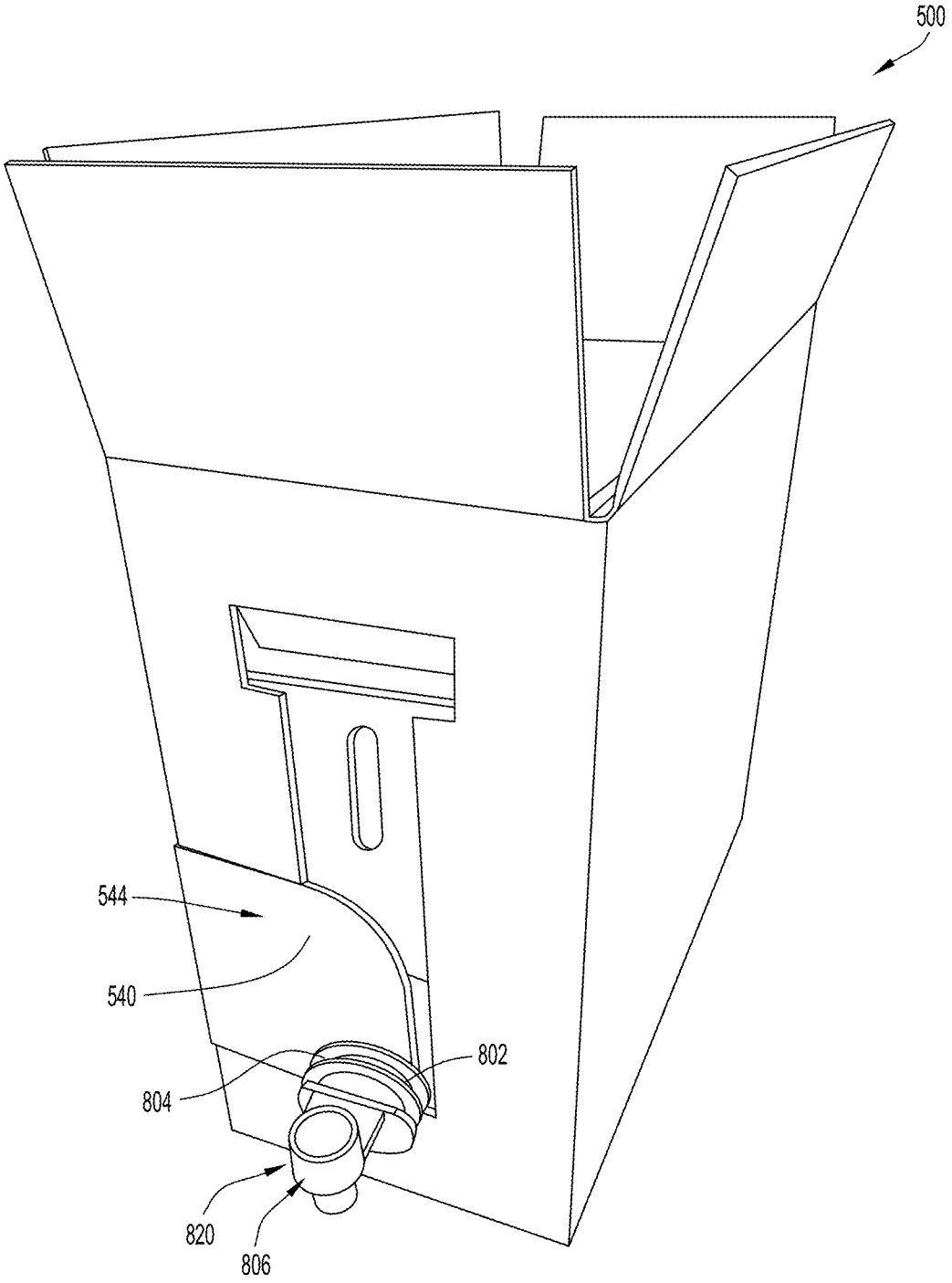

Turning to FIG. 15, the access door 540 has been moved back to its closed position 544 in which it engages the release mechanism 800. The body 802 of the release mechanism 800 includes several ribs 804 formed therein that define grooves between adjacent ribs 804. When the access door 540 is closed, the lower surface of the door, which is the edge 552 of where the small door 550 originally was located (see FIG. 11), engages the body 802 of the release mechanism 800. In particular, the access door 540 engages one of the grooves formed by the ribs 804 on the body 802. The result is that the release mechanism 800 extends through the opening 558 (see FIG. 13) where small door 550 was originally located, and the release mechanism 800 is retained in its extended position 820 relative to the housing 510. When the dispensing mechanism 806 of the release mechanism 800 is accessible outside of the housing 510, it can be manipulated by a user to dispense contents from the storage unit 850 as desired.

When the user has finished dispensing the desired amount of contents from the storage unit 850, the user can move the release mechanism 800 back inside of the housing 510, and store the container 500 on a shelf or at another desired location. To move the release mechanism 800 inside of the housing 510, the user has to close the actuator 808 of the release mechanism 800 and open the access door 540. Once the access door 540 is moved to its opened position, it has been disengaged from the body 802 of the release mechanism 800. The user can then move the release mechanism 800 inside of the wall 512 of the housing 510.

Figure 16:
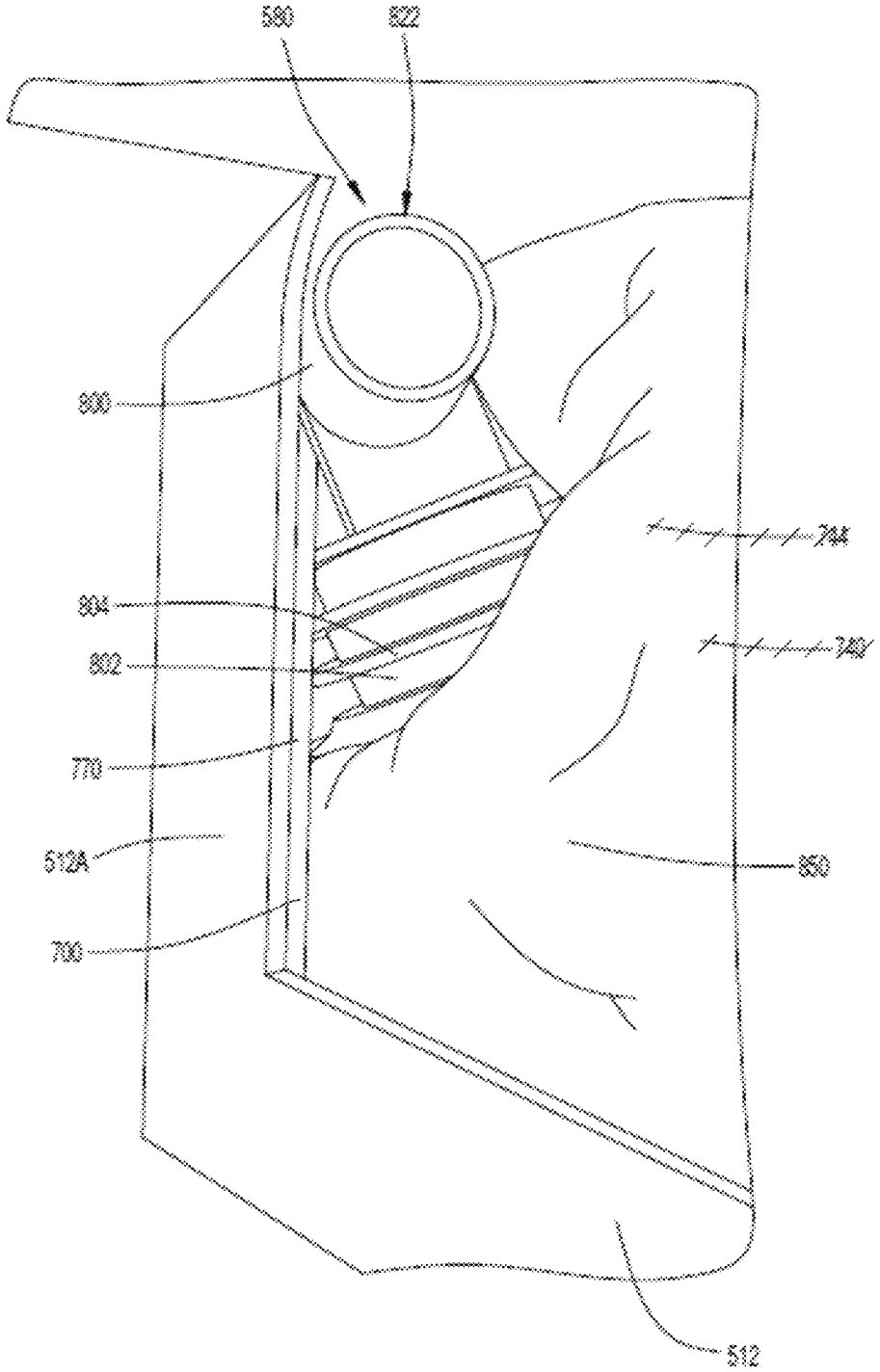
FIG. 16 is a top view of a portion of the container illustrated in FIG. 11 showing the release mechanism in its retracted position.

As shown in FIG. 16, the release mechanism 800 is moved to a retracted position 822 in the interior region 580 of the housing 510. The release mechanism 800 remains coupled to the storage unit 850 in the retracted position 822. In addition, both the actuator 808 and the body 802 with ribs 804 are positioned in the interior region 580.

Figure 19:
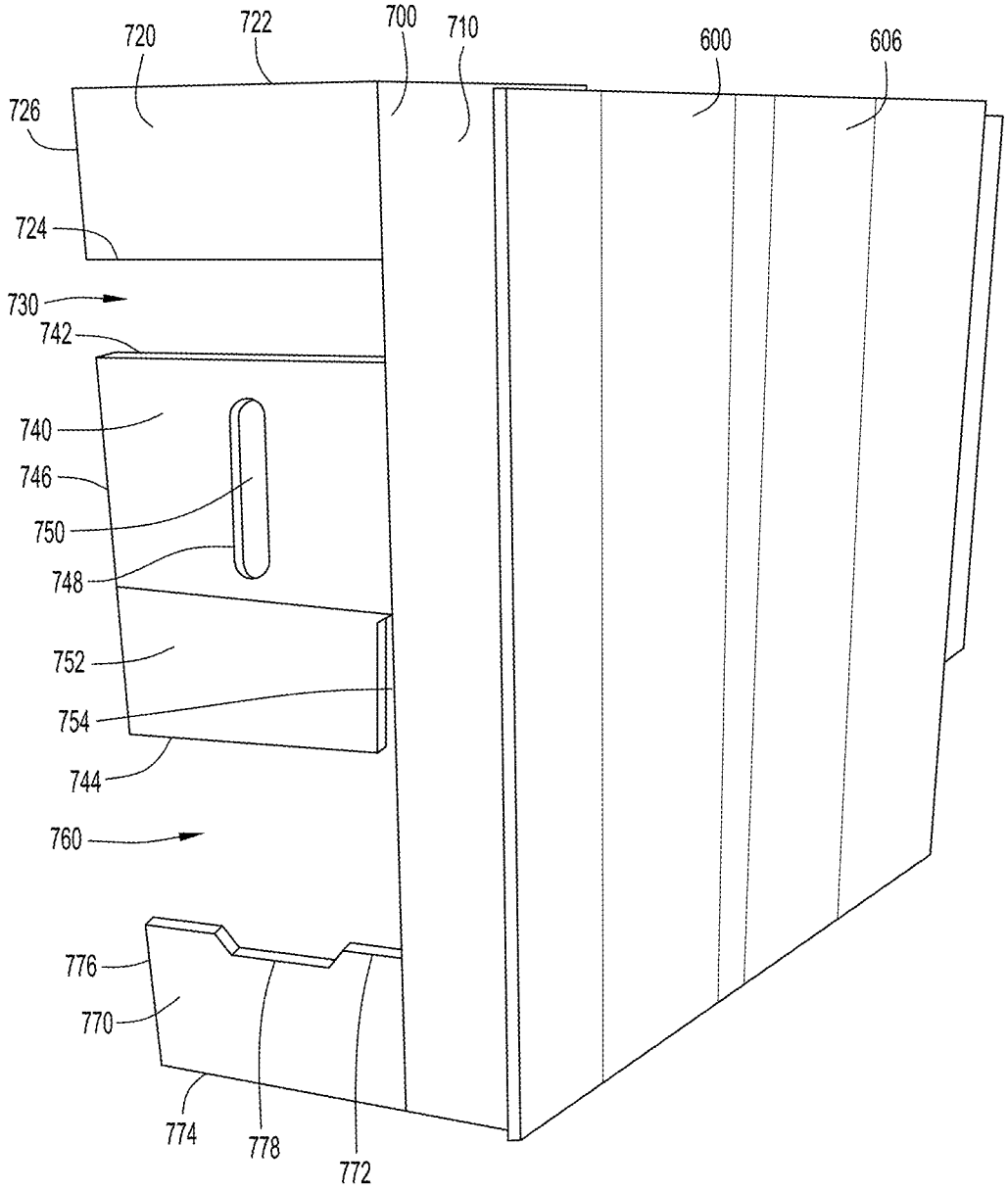
FIGS. 19-20 are perspective views of an embodiment of an insert of the container illustrated in FIG. 11.

In this embodiment, the inner panel 700 includes a lower panel portion 770 that is positioned inside of the lower end portion 512A of wall 512. As shown in FIG. 19, there is a gap or opening between the lower end 744 of panel portion 740 and the upper edge or end of the lower panel portion 770. That opening allows the user to move the release mechanism 800 into and out of the interior region 580. Referring back to FIG. 16, the lower panel portion 770 provides a second wall member at the lower end portion 512A of wall 512 to increase the thickness of the wall 512 in that area, which provides additional structural support to the wall 512 of the housing 510. The additional support enhances the maintaining of the release mechanism 800 and the storage unit 850 inside of the housing 510.

Figure 17:
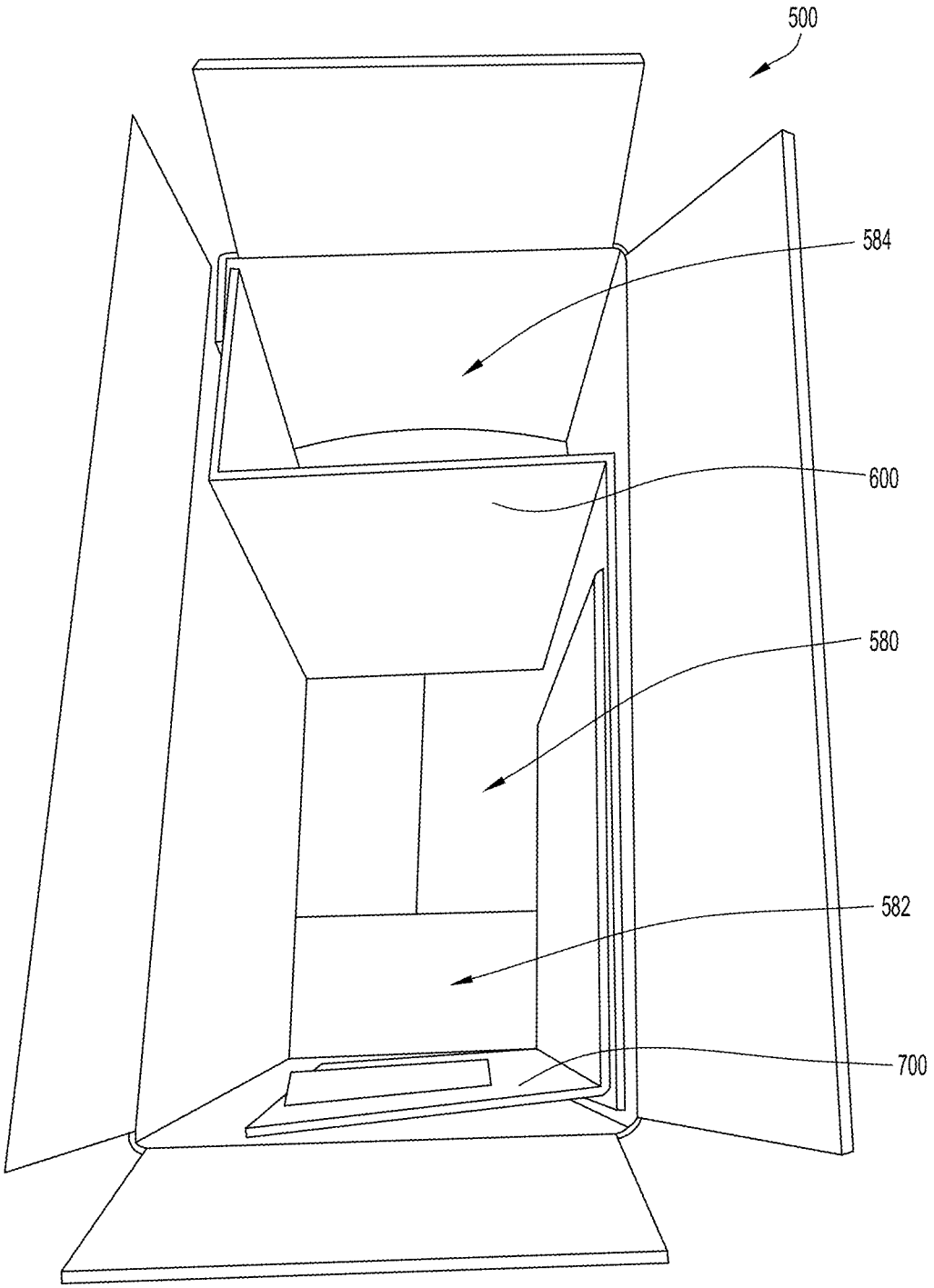
FIGS. 17-18 are top views of the container illustrated in FIG. 11.
Figure 18:
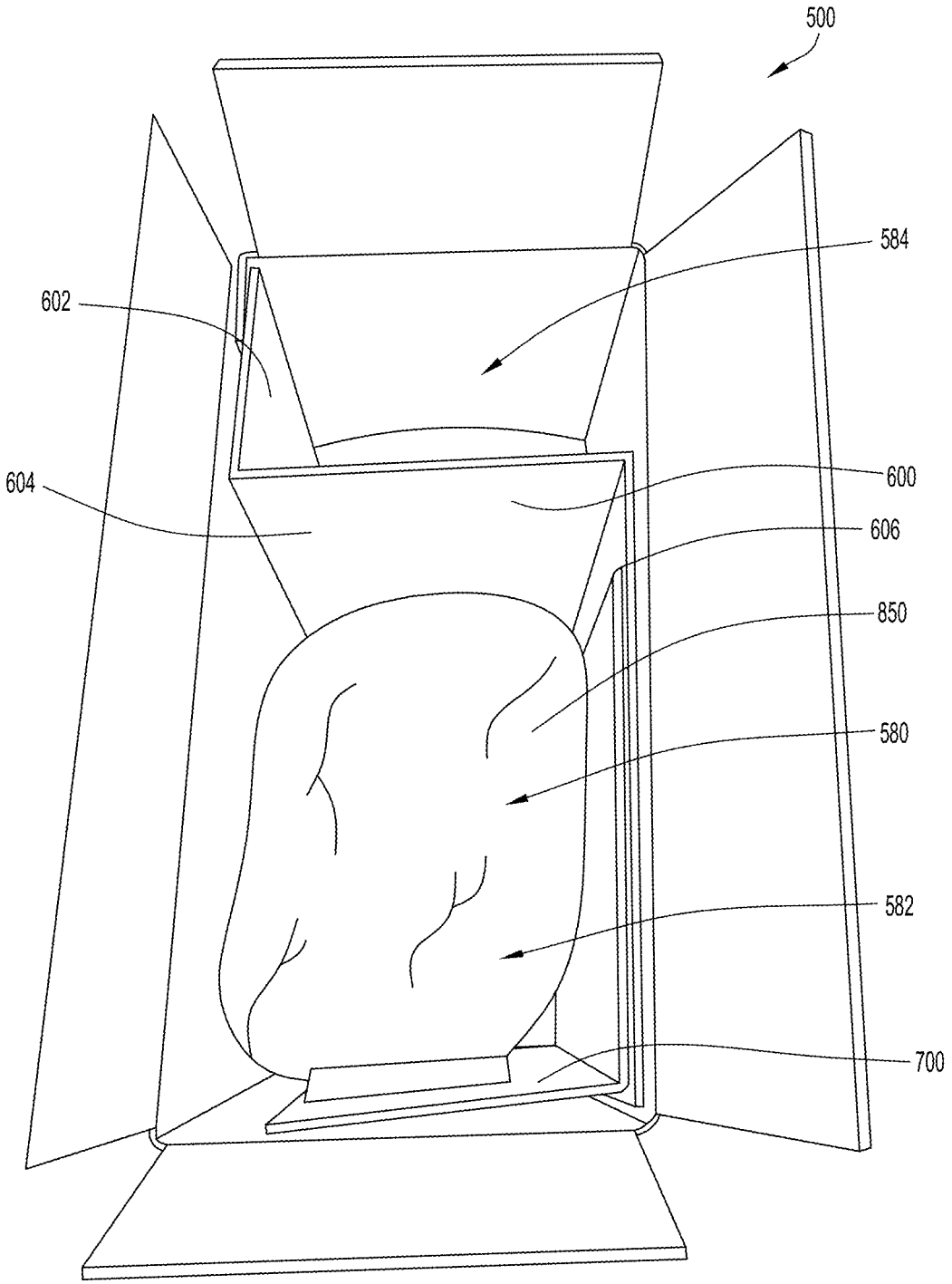

Referring to FIGS. 17 and 18, top perspective views of the container 500 are illustrated. FIG. 17 shows the container 500 without any components inside, and FIG. 18 shows the container 500 with storage unit 850 located therein. Illustrated in FIG. 17 is an internal divider or barrier 600 located in housing 510. The internal divider or barrier 600 provides lateral support for the housing 510 and also divides the interior region 580 of the housing 510 into two different interior region portions 582 and 584. As shown in FIG. 18, the storage unit 850 is located in interior region portion 582. The storage unit 850 may contain a liquid, such as a cleaning or disinfecting solution, or a concentrate. While not shown in FIG. 18, the interior region portion 584 can have a dispensing device, such as dispensing device 110 shown in FIG. 8, located therein.

In one embodiment, the internal divider 600 has a first portion 602 that extends along a portion of one wall of the housing 510, a second or middle portion 604 that extends laterally across the interior region 580, and a third portion 606 that extends along a portion of another wall of the housing 510. The various features of the internal divider 600 are illustrated in and described relative to FIGS. 19 and 20. The panel 700 is shown at one end of the internal divider 600.

Referring to FIG. 19, the internal divider 600 includes the panel 700 coupled to the third portion 606 of internal divider 600. In one embodiment, the panel 700 can be formed separately from internal divider 600 and coupled thereto. In an alternative embodiment, the panel 700 can be formed integrally with internal divider 600. The panel 700 can be referred to as a holding or retaining panel.

In the illustrated embodiment, the panel 700 includes a body 710 that extends from an upper end of the panel 700 to a lower end of the panel 700. At the upper end of the panel 700, an upper portion 720 is coupled to the body 710. The upper portion 720 has an upper end or edge 722, an opposite lower end or edge 724, and a distal or free end or edge 726.

The panel 700 also includes a middle portion 740, which was described above relative to FIGS. 13-16, that extends from the body 710. The middle portion 740 and the upper portion 720 define a space or opening 730 therebetween. Opening 730 is aligned with the handle portion opening 520 described above. By aligning at least a portion of the opening 730 and handle portion opening 520, a user can insert a hand into both of those openings.

As shown in FIG. 19, and discussed above relative to FIG. 14, the middle portion 740 has an upper end or edge 742, an opposite lower end or edge 744, and a distal or free end or edge 746. The middle portion 740 has an edge 748 defines the opening 750, that can be used to view the level of contents in the storage unit 850. The opening 750 may have any suitable shape (e.g., rectangle, oval, circle, and any suitable combinations of one or more shapes) that would allow a user to view the contents of the storage unit. The middle portion 740 also includes a depending portion 752 that is separated from the body 710 by a slot 754. The depending portion 752 being slightly movable relative to the rest of the panel 700 facilitates the movements of the release mechanism 800 by a user.

The panel 700 also includes a lower portion 770 that extends from the body 710. The lower portion 770 and the middle portion 740 define a space or opening 760 therebetween. Opening 760 is utilized for the extending and retracting of the release mechanism 800, which was described above. The opening 760 is aligned with a portion of the opening 536 in the wall 512, which allows for the release mechanism 800 to extend through both opening 536 and opening 760. In this embodiment, the sizes of openings 536 and 760 are different from each other. By having different sized openings, the wall 512 and the panel 700 can overlap and provide additional structural support to each other to retain the storage unit 850 in the housing 510 while the release mechanism 800 is either of its retracted and extended positions. The lower portion 770 provides additional support as a second wall member that helps retain the release mechanism 800 and storage unit 850 in the housing, as described above relative to FIG. 16.

The lower portion 770 has an upper end or edge 772, an opposite lower end or edge 774, and a distal or free end or edge 776. The upper edge 772 includes a notch 778 formed therein that receives the release mechanism 800 when the release mechanism 800 is moved to is extended position.

Figure 20:
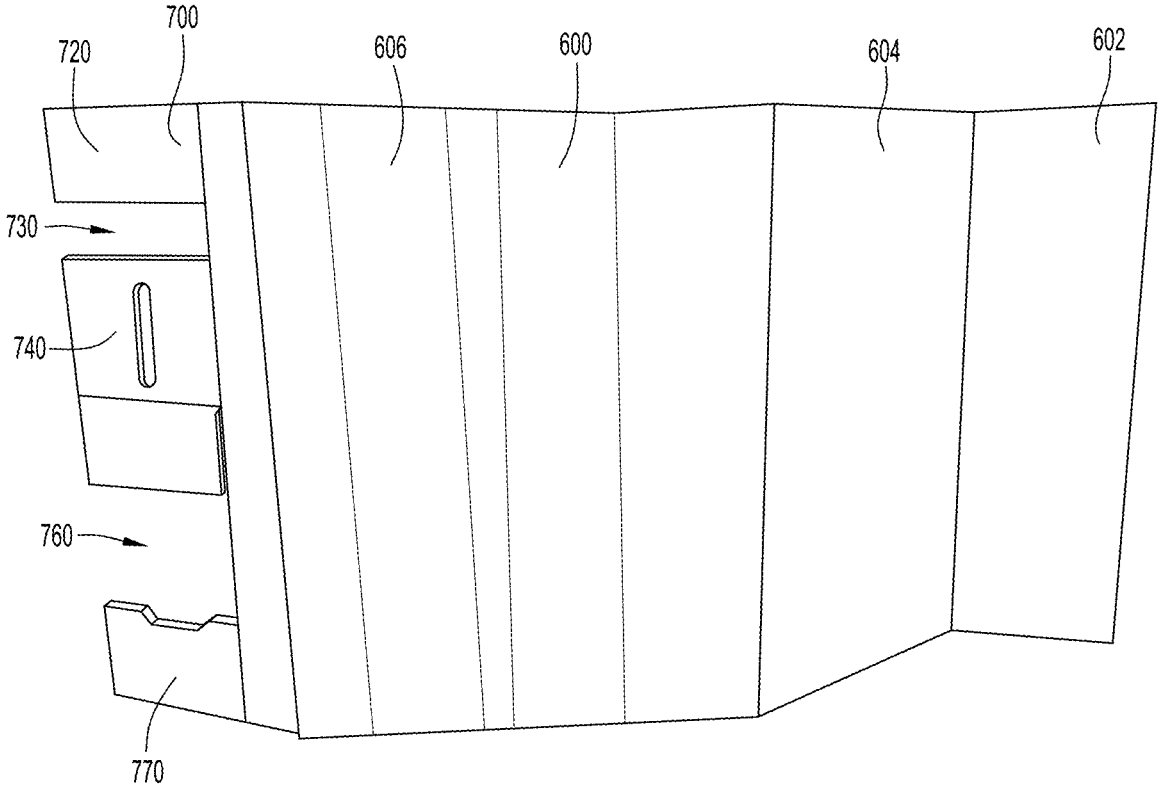

Turning to FIG. 20, the internal divider 600 is illustrated in an extended or expanded configuration. The various portions 602, 604, and 606 of the internal divider 600 are shown as well as the panel 700 that is coupled to the internal divider 600. The upper portion 720, the middle portion 740, and the lower portion 770 are shown with the openings 730 and 760 located between them.

Figure 21:
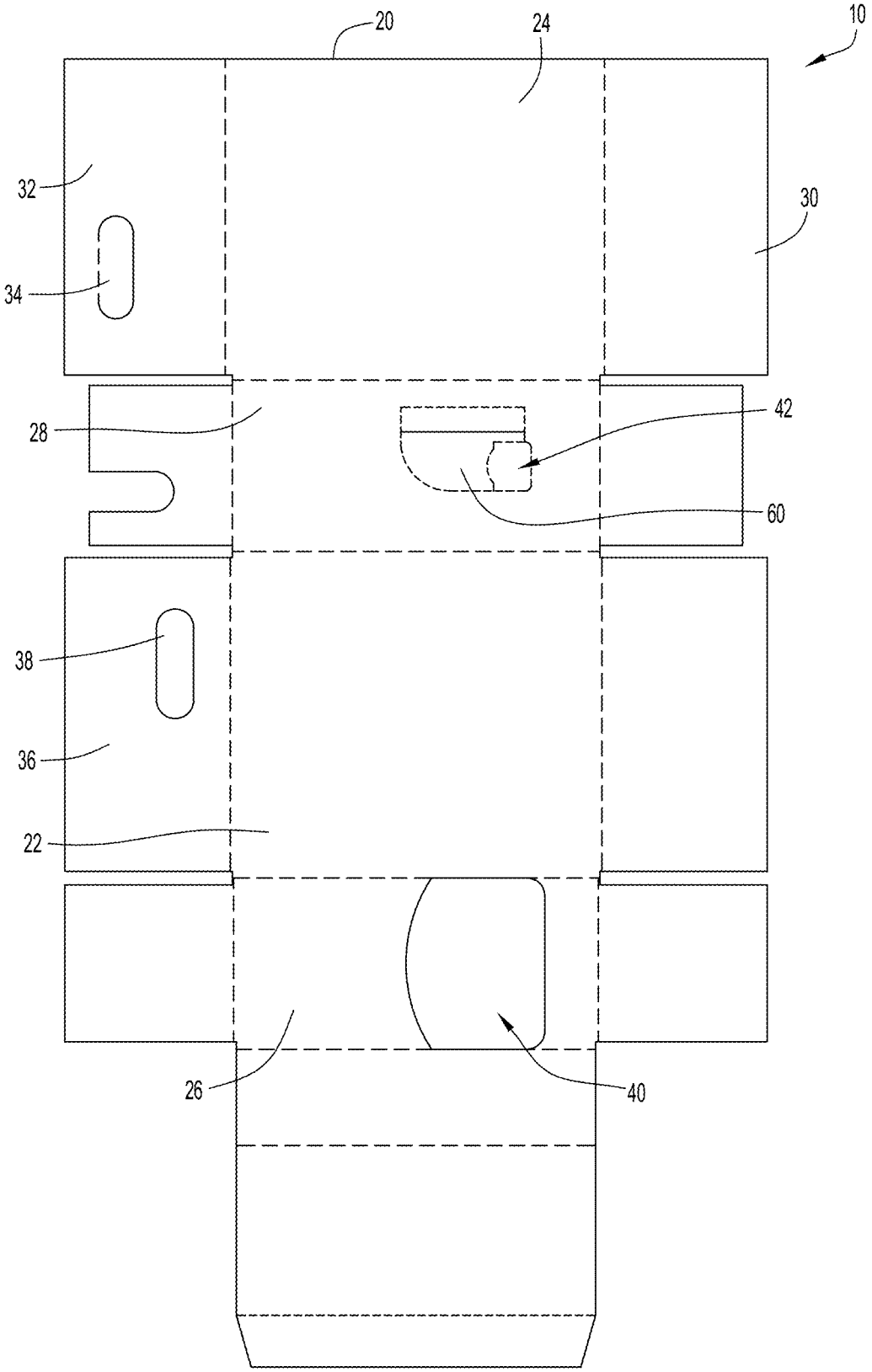
FIG. 21 is a plan view of the container illustrated in FIG. 1 in a collapsed or flattened configuration.

Turning to FIG. 21, a plan view of the material that is folded to form the housing 20 of container 10 is illustrated in a collapsed or flattened configuration. In this embodiment, the various components of the housing 20 are formed as a single piece of material. The piece of material includes the front wall 22, the rear wall 24, the top flaps 32 and 36 (with openings 34 and 38, respectively), and the bottom flaps 30. Side walls 26 and 28 with the viewing opening 40 and the dispensing opening 42, respectively, are shown, as well as access door 60.

Figure 22:
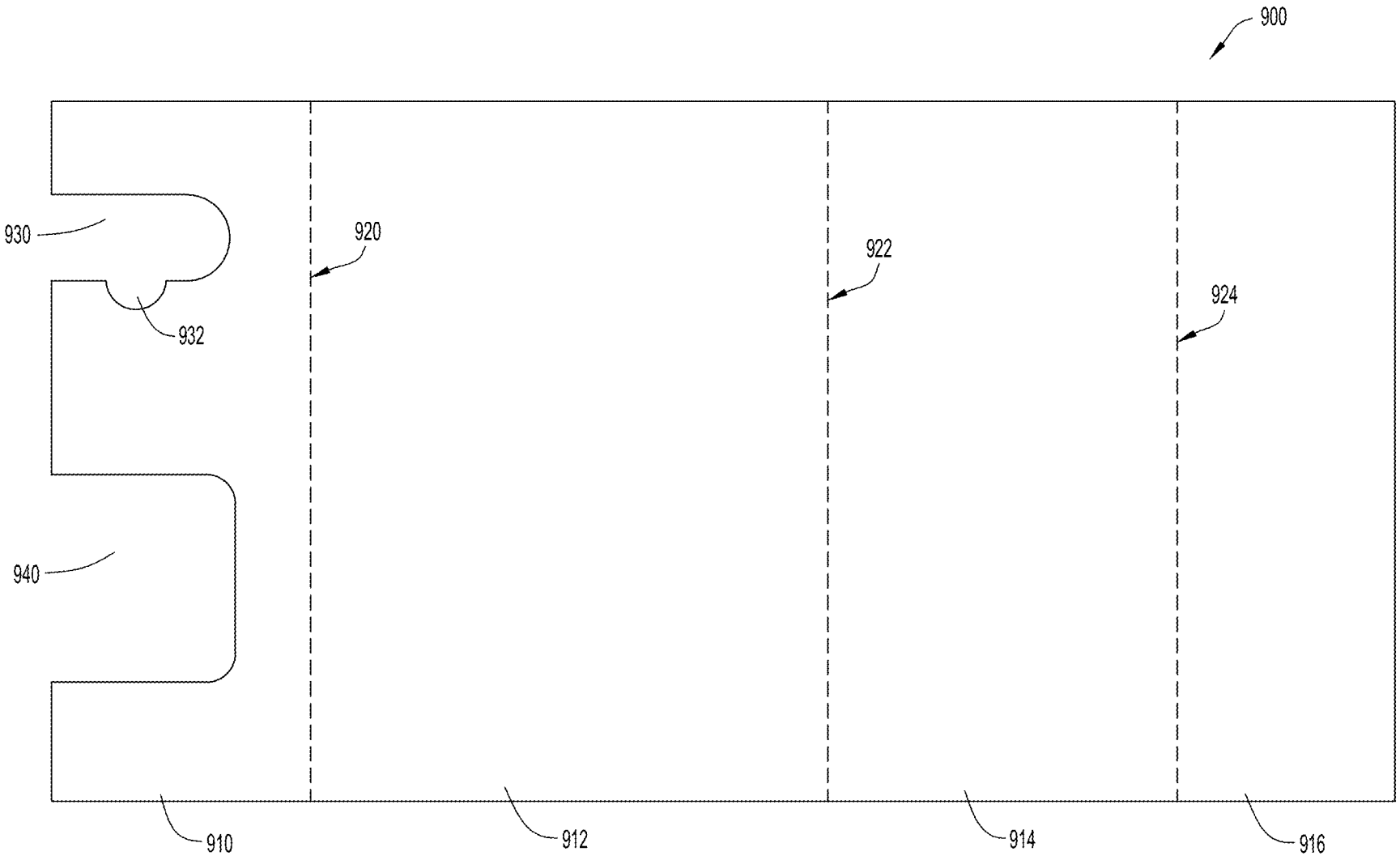
FIG. 22 is a plan view of an embodiment of a divider in a collapsed or flattened configuration.

Turning to FIG. 22, a plan view of the material that is folded to form a divider that can be used with a container disclosed herein is illustrated. In this embodiment, the divider 900 has several different panels or panel portions 910, 912, 914, and 916, which are separated by folds 920, 922, and 924. Panel 910 includes openings 930 and 940 formed therein, with opening 930 having an additional notch 932.

Figure 23:
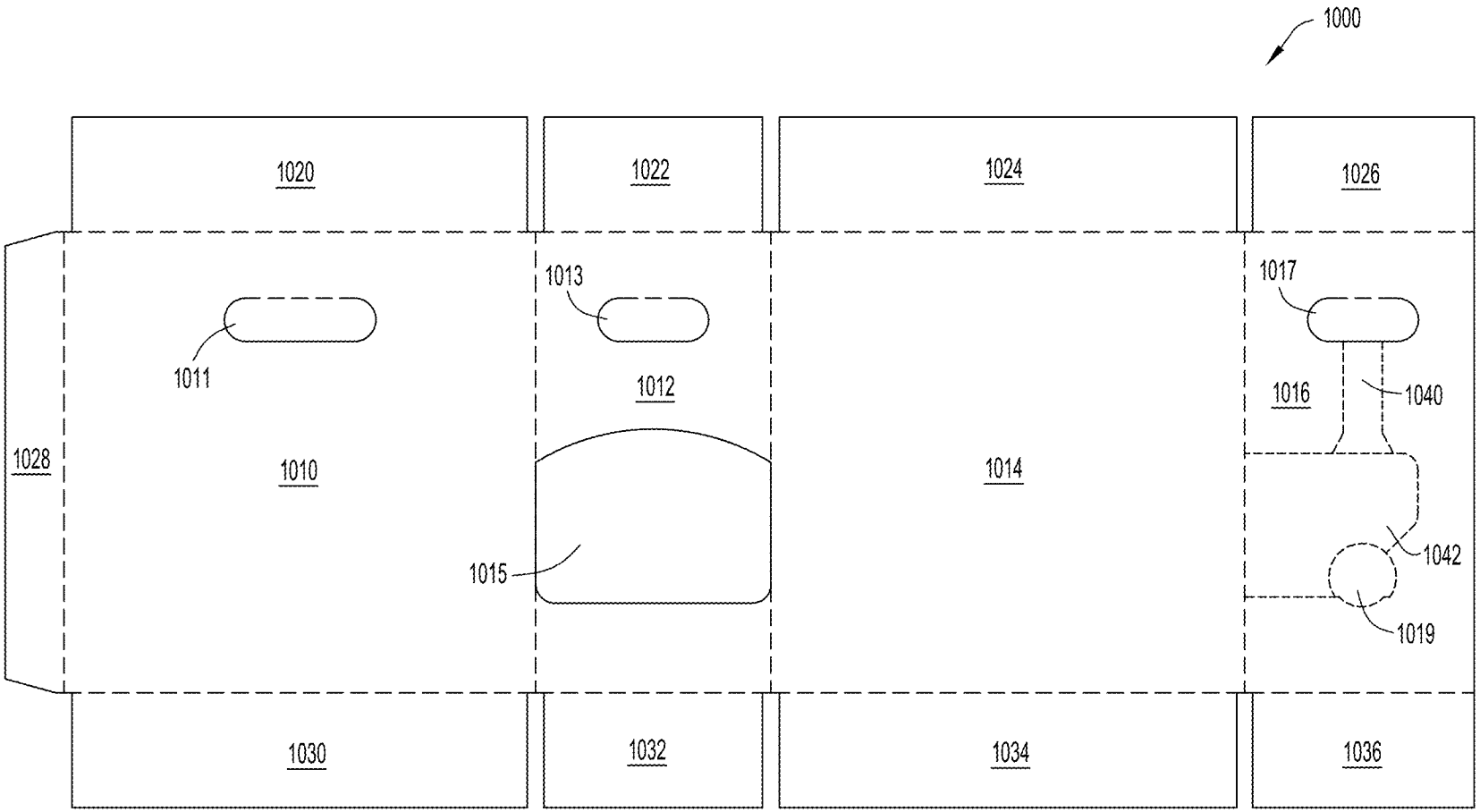
FIG. 23 is a plan view of an embodiment of a container in a collapsed or flattened configuration.

Turning to FIG. 23, a plan view of the material that is folded to form another embodiment of a container is illustrated. In this embodiment, the container 1000 is formed of several walls 1010, 1012, 1014, and 1016 that are separated by folds in the material. Wall 1010 has a handle opening 1011 formed therein. Wall 1012 has a handle opening 1013 formed therein. In addition, wall 1012 has another opening 1015 formed therein as well. Wall 1016 includes a handle opening 1017, an access portion 1040, an access portion 1042, and a small door 1019. Each of the access portions 1040 and 1042 and the small door 1019 is surrounded by perforations, which facilitates the removal of the access portion 1040, the access portion 1042, and the small door 1019. Several flaps 1020, 1022, 1024, 1026, 1028, 1030, 1032, 1034, and 1036 are coupled to different ones of the walls 1010, 1012, 1014, and 1016.

In an embodiment of a container with a bleach-based composition in its storage unit, the release mechanism may include a child-resistant tap feature to provide additional safety for the product. In addition, the plastics utilized in the present invention may include additives, such as long term heat aging materials or anti-oxidants or stabilizers, which combat plastic deterioration.

In alternative implementations, a container as described herein can be used for any type of bag-in-box container for a liquid product, including beverages, such as wine, motor oils, and chemicals. Also, while the panel and the internal divider are made from corrugated board in one embodiment, in other embodiments they can be made of alternative materials, such as paperboard or plastic.

Like numbers refer to like elements throughout. The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

It will also be understood that, as used herein, the terms "alternative," example," "exemplary," and derivatives thereof are intended to refer to non-limiting examples and/or variants embodiments discussed herein, and are not intended to indicate preference for one or more embodiments discussed herein compared to one or more other embodiments. The invention being thus described, it will be apparent that the same may be varied in many ways. Such variations are not to be regarded as a departure from the spirit and scope of the invention, and all such modifications as would be obvious to one skilled in the art are to be included within the scope of the following claims.

What is claimed is:

1. A container, comprising:

a housing defining an interior region, the housing including a handle opening, a wall, and a panel located in the interior region adjacent to the wall, the wall includes a first opening formed therein, the panel includes a second opening formed therein, the second opening is aligned with the first opening, and the panel includes a third opening that is aligned with the handle opening;

a storage unit disposed in the interior region;

a composition disposed in the storage unit;

a release coupled to the storage unit, the release being manipulatable to allow the composition to exit the storage unit, wherein the release can extend through the first opening in the wall and through the second opening in the panel; and a dispensing device disposed in the interior region, the dispensing device including a chamber and one of a sprayer or a closure.

2. The container of claim 1, wherein the interior region includes a first interior region portion and a second interior region portion, and the housing includes a barrier disposed in the interior region, the barrier being located between the first interior region portion and the second interior region portion.

3. The container of claim 2, wherein the storage unit is located in the first interior region portion, and the dispensing device is disposed in the second interior region portion.

4. The container of claim 1, wherein the housing includes a main body portion and a removable portion coupled to the main body portion via perforations, and the removable portion can be separated from the main body portion due to the perforations.

5. The container of claim 1, wherein the housing includes an access door coupled thereto and movable between a closed position and an opened position, and the access door includes a recess formed therein that receives a portion of the release when the release is in an extended position relative to the housing.

6. The container of claim 1, wherein the housing includes a plurality of walls, and one of the plurality of walls includes the handle opening formed therein and a removable portion coupled thereto that can be separated from the housing.

7. The container of claim 6, wherein removal of the removable portion forms a wall opening through the housing, the wall opening extends from an exterior of the housing to an interior of the housing.

8. The container of claim 7, wherein the wall opening is in communication with the handle opening.

9. The container of claim 7, wherein the housing includes a panel located in the interior region, the panel is positioned adjacent to the wall opening, and the panel blocks at least a portion of the wall opening.

10. The container of claim 1, wherein the first opening has a different size than the second opening.

11. The container of claim 1, wherein the panel blocks a portion of the first opening, and the panel in combination with the wall retains the storage unit in the housing.

12. The container of claim 1, further comprising:

an internal divider that separates the interior region into a first interior region portion and a second interior region portion, wherein the storage unit is located in the first interior region portion, and the panel is coupled to the internal divider.

13. A container, comprising:

a housing including a plurality of walls defining an interior region;

a storage unit disposed in the interior region, the storage unit including:

a composition disposed therein, and a release coupled thereto, the release being manipulatable to allow the composition to exit the storage unit, the release being positionable in a retracted position and in an extended position;

a panel disposed in the interior region, the panel being located adjacent to one of the plurality of walls of the housing, and the panel having an opening through which the release extends when in its extended position; and an internal divider that separates the interior region into a first interior region portion and a second interior region portion, wherein the storage unit is located in the first interior region portion, and the panel is coupled to the internal divider.

14. The container of claim 13, wherein the one of the plurality of walls of the housing includes a removable portion coupled thereto, removal of the removable portion from the one of the plurality of walls forms a wall opening, and the panel is located adjacent to the wall opening and blocks a portion of the wall opening.

15. The container of claim 13, wherein the housing includes a door coupled thereto, the door being movable between a closed position and an opened position relative to the housing, and the door engages a portion of the release when the release is in an extended position to secure the release in its extended position.

16. The container of claim 13, wherein one of the plurality of walls includes a handle opening formed therein and a removable portion coupled thereto that can be separated from the housing.

17. A container, comprising:

a housing including a plurality of walls defining an interior region, one of the plurality of walls including a removable portion coupled thereto, a first opening being formed in the one of the plurality of walls when the removable portion is separated therefrom;

a storage unit disposed in the interior region, the storage unit including:

a chamber in which a composition is disposed, and a release coupled thereto, the release being actuatable to release the composition from the chamber of the storage unit, the release being disposable in a retracted position and in an extended position relative to the housing;

a panel disposed in the interior region of the housing, the panel having a second opening formed therein, wherein the release extends through the first opening and the second opening when the release is in its extended position; and an internal divider that separates the interior region into a first interior region portion and a second interior region portion, wherein the storage unit is located in the first interior region portion, and the panel is coupled to the internal divider.

18. The container of claim 17, wherein the panel is located adjacent to the first opening and blocks a portion of the first opening.

19. The container of claim 18, wherein the one of the plurality of walls includes a third opening formed therein, and the first opening is in communication with the third opening.

20. The container of claim 17, wherein the one of the plurality of walls includes a handle opening formed therein.

* * * * *